US006942765B2

(12) United States Patent
Griego et al.

(10) Patent No.: US 6,942,765 B2
(45) Date of Patent: Sep. 13, 2005

(54) SUBMICRON AND NANO SIZE PARTICLE ENCAPSULATION BY ELECTROCHEMICAL PROCESS AND APPARATUS

(75) Inventors: Thomas P. Griego, Corrales, NM (US); John W. Eichman, III, Grants, NM (US)

(73) Assignee: Surfect Technologies, Inc., Albuquerque, NM (US)

( * ) Notice: Subject to any disclaimer, the term of this patent is extended or adjusted under 35 U.S.C. 154(b) by 303 days.

(21) Appl. No.: 09/872,214

(22) Filed: May 31, 2001

(65) Prior Publication Data

US 2002/0179430 A1 Dec. 5, 2002

(51) Int. Cl.[7] ..... C25D 5/04; C25D 17/00

(52) U.S. Cl. ..... 204/199; 204/201; 204/212; 204/213; 204/242; 204/273; 204/275.1

(58) Field of Search ..... 204/199, 201, 204/212, 213, 242, 273, 275.1

(56) References Cited

U.S. PATENT DOCUMENTS 2,865,831 A 12/1958 Ransohoff
3,359,195 A 12/1967 Hojyo
3,425,926 A 2/1969 Hojyo
4,701,248 A 10/1987 Birkle et al.
5,487,824 A 1/1996 Griego
5,565,079 A 10/1996 Griego
5,879,520 A 3/1999 Griego
2002/0139685 A1 10/2002 Colombier et al.

*Primary Examiner*—Arun S. Phasge
(74) *Attorney, Agent, or Firm*—Rod D. Baker; Jeffrey D. Myers; Philip D. Askenazy

(57) ABSTRACT

An apparatus and method for coating or treating powdered material, particularly ultra-fine powders in the nanometer or submicron range of mean diameters, by electrolytic processes. A platen is mounted for rotation upon a fixed shaft, and a rotary flow-through electrolytic cell is mounted upon a platen for rotation thereon, the cell's axis of rotation being offset from the platen's axis of rotation. The cells axis of rotation revolves around the platen's axis as the platen rotates. The electrolytic cell accordingly undergoes a planetary rotation, as the cell revolves around the platen's axis of rotation. The planetary rotation of the cell allows the powdered material to be collected by centrifugal force and constantly agitated to promote uniform electroplating. An electrode array and rolling contact system are supplied which allow electric potential to be applied only to those electrodes actually in contact with the powdered material to be treated

24 Claims, 19 Drawing Sheets

SUBMICRON AND NANO SIZE PARTICLE ENCAPSULATION BY ELECTROCHEMICAL PROCESS AND APPARATUS

BACKGROUND OF THE INVENTION

1. Field of the Invention (Technical Field)

The present invention relates to apparatuses and methods for electroplating and electrochemically modifying the surface finish of metal and semiconductor powders, particularly by continuous centrifugal means for encapsulation, anodizing, electroetching, electroforming, electrophoretic coating, electrosynthesis, and electrodeposition on powders without limitation on particle size, specifically including submicron- or nano-sized particles.

2. Background Art

The technologies for electrochemical enhancement of the surfaces of the particles in bulk powders has previously been limited to two main types: chemical copper and electrolytic nickel auto-catalytic processes; and rotary electroplating devices which require frequent stopping and starting of the electrolytic cell's rotation to tumble the powder to achieve uniform dispersion of the coating upon the particles. A limitation of the previous art using chemical or auto-catalytic processes is the cost of the chemical consumption due to the enormous surface areas of powders. Another limitation of known devices using the rotary techniques is the need to stop the cell to tumble the powder in order to disperse the coating and prevent agglomeration of the particles. Known devices of the latter type known in the art are typified by the disclosure of U.S. Pat. No. 5,879,520, the teachings of which are hereby incorporated by reference.

Previous rotary flow-through devices are capable of centrifugal clarification of the particles in solution and fixing them against the cathode ring for electrical contact. A disadvantage occurs, however, when rotation of the cell must be stopped to tumble the powder particles to foster even electrodeposition upon the individual particles. During this "stop phase," the particles are re-suspended in the electrolyte solution. If the particles are of sufficient density, continuing the rotation of the cell re-clarifies the solution and again fixes the particles against the electrical contact ring, but the need periodically to stop and re-start cell rotation prolongs total processing times. Further, in the case of submicron-sized, low mass powders, the method of repeatedly stopping and resuming cell rotation is unacceptable from a practical standpoint, because the material particles remain in suspension (rather than in contact with the cathode) for impermissibly, nearly indefinite, lengths of time.

Also, laboratory experimentation and commercial application of the known rotary flow-through devices resulted in a determination that such devices have a powder particle size lower limit of approximately 20 micrometers for most common metals. These devices often have limitations related to the substrate powder's particle density, as well. Because previous rotary flow-through devices use a sintered membrane to allow the electrolyte to flow through the cell, a practical particle size limit occurs when the opening area of the sintered membrane must be smaller than the particle size. For powders below 50 micrometers mean particle diameter, the sintered membrane pores must be reduced to 25 micrometers. For powders below 20 micrometers, the sintered membrane pores must be 10 micrometers. When the sintered membrane pores are reduced below 10 micrometers, the discharge of electrolyte through the membrane is significantly impaired, which in turn depletes the ion species in the electrolyte, dramatically reducing the performance of the device. Because the distribution of size of the particles varies, it is possible to have particles smaller or equal in diameter to the openings in the sintered membrane, which in turn causes clogging or blinding of the membrane—further reducing performance. If the solution flow rate is increased to compensate for the ion depletion, the lightweight particles will overflow the cell, causing unwanted material loss and damage to the system.

Another problem with some previous rotary flow-through devices, such as the device of the U.S. Pat. No. 5,879,520, is that they require a complicated level control sensor to prevent the electrolyte solution from overflowing the top of the cell during the stop phase. This further limits the efficiency of solution flow, which also leads to ion depletion.

Further background in the field of rotary flow-through electroforming/electrodeposition devices and methods is supplied by U.S. Pat. Nos. 5,487,824 and 5,565,079, the disclosures of which are hereby incorporated by reference.

Moreover, each time the cell rotation is resumed (after stopping to tumble the substrate powder), time is required to clarify the solution and re-fix the particles to the face of the cathode ring; heavier particles are thrown into renewed contact with the cathode first, while finer particles require comparatively more time to move outward under centrifugal force. This results in heavier particles having preferential electrical contact with the cathode, resulting in a wide variance in the uniformity of the thickness distribution. In many cases, ultrafine particles will receive no electrodeposition at all.

Another limitation of known rotary flow-through devices is that the rectifier or power supply must be switched off and on in sync with the stopping and starting of the rotation of the cell. Besides causing extended process time during the off cycle, such intermittent voltage processes risk potential chemical damage to the substrate powder when no voltage potential is present.

Another limitation of known rotary flow-through device is the diameter and overall size of the cell, which had to be optimized to provide adequate stopping and starting performance. If the cell diameter is too large, the distance between the electrodes and the distance of travel of the particles became too great for efficient processing.

Another limitation of known rotary flow-through device is the required stop/start sequence means that the particles are fixed at the cathode during the on time, increasing the possibility of undesirably fusing or electroforming substrate components together. This obligates the high frequency stopping/starting to ameliorate agglomeration.

The foremost requirements for commercial electrodeposition apparatuses are to achieve cathode efficiency (e.g., 60–100 percent efficiency), prevent fusing or agglomeration of the particles, achieve high thickness uniformity, not corrode or damage the substrate powder, perform the electrodeposition in reasonable process time, and contain all particles in the apparatus with reasonable material handling methodologies.

SUMMARY OF THE INVENTION (DISCLOSURE OF THE INVENTION)

The invention is a continuous rotary flow-through electrodeposition system including a rotating platen supporting a vertical rotating cell on an eccentric axis. The system has a plurality of nozzles and electrodes alignable concentrically to a rotating platen. The eccentric rotating cell is actuated by a planetary gear that allows the cell to orbit around the axis point of the centered platen and electrode.

The present invention also features a rotating cell with sectioned electrical contacts molded into a plastic bowl or vessel, isolating the electrical contact exposed at the inside of the cell and extending to the perimeter of the bowl for sequential current feed from a rotating slip ring device. This innovation promotes catalytic efficiency by bussing current only to the "outermost" contacts that are in contact with the powdered materials.

This invention additionally uses an upper dome to complete the cell that features a helical inner flange or ramp. During clockwise rotation of the cell, the upper dome continuously forces the substrate materials downward to maintain their contact with the cell cathode contacts. Further, by reversing the cell rotation to counterclockwise, material can be augered out of the cell to facilitate unloading the finished powder into the collection drain basin.

The cell is provided with a catch basin and a canopy that catch flow-through electrolyte for return to the solution reservoir.

The present invention can also be used with or without a sintered membrane or laser cut slots to allow solution to flow-through, since the cell is configured to permit overflow of process solution from the top port thereof without discharging therewith the powder material being treated. Further, the present invention operates with continuous rotation, eliminating the need to stop and start the cell to tumble parts.

The present invention has no limitation in diameter of the cell, allowing for increased loading capacities due to the continuous operation of the cell and elimination of the stop/start sequence.

In the present invention, the particles are continuously tumbled in contact with the electrical contacts, thereby improving the dispersion of the coating over the surface of each particle and eliminating potential fusing or agglomeration of particles.

A primary object of the processes of the invention is to provide effective electrolytic microencapsulation of submicron-sized or "nano scale" particles.

A primary object of the apparatus of the present invention is to permit the multi-step electroplating process without physical transfer of the plating fixture or cumbersome manual exchange of solutions.

A primary advantage of the invention is that it can process submicron-sized materials with high efficiency, with or without a sintered membrane or slotted dome.

Another advantage of the present apparatus is that it has virtually no limitation on solution flow rate; thus, the electrolytes ion species can remain at optimum levels during the high mass transfer that is required for the high surface area powdered substrate.

A primary advantage of the process of the invention is that a wide range of useful particles and materials can be made thereby including, but not limited to:

Inert micron scale isotope particles for blood trace.

Critical stoichiometry alloy composition powders.

Reduced cost noble metal catalytic powders.

Alloy powders for powder metal forming.

Electrophoretic coated iron for soft magnetic powder.

Battery and fuel cell negative electrode powders.

Micro-ball grid array spheres.

Microencapsulation of radioactive fuel rods.

Electrosynthesis of ceramic oxides.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
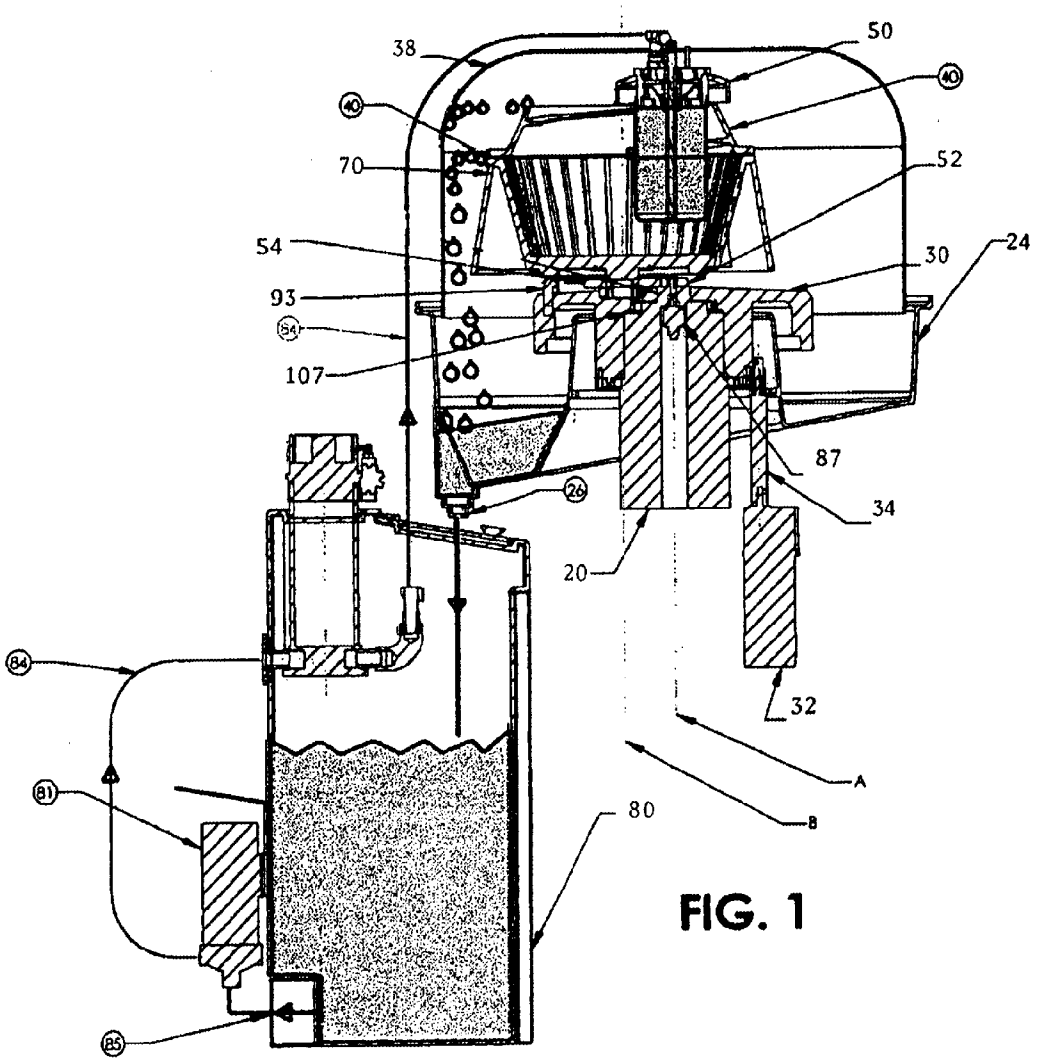
FIG. 1 is a side sectional view of the overall apparatus according a preferred embodiment of the present invention.

DESCRIPTION OF THE PREFERRED EMBODIMENTS (BEST MODES FOR CARRYING OUT THE INVENTION)

The present invention offers major improvements to apparatuses and methods in electrolytic cell technologies for microencapsulating or coating powdered materials. The apparatus of the invention incorporates some of the desirable aspects of devices and processes known in the art, such as multiple return drains and multiple selectable feed nozzles, while yet overcoming various disadvantages manifested in previous efforts.

The present invention capitalizes upon the fundamental concept of harnessing centrifugal force to compact bulk materials, particularly submicron- or nano- sized powders, in solution (preferably aqueous) against an electrolytic cathode contact. Throughout this disclosure and in the claims, "substrate material" or "substrate powder" refers to the bulk materials to be treated, and specifically includes but is not limited to super-fine conductive and semi-conductive powders having mean particle diameters in the nanometer or submicron range.

The central component of the apparatus is the cell, which features an upper dome mounted upon a bowl. The substrate material is loaded through a top opening in the cell, and the plating cell is rotated at sufficiently high rpm to centrifugally cast the substrate material against the cathode contact at the outer perimeter of the cell. Electroplating solution is then introduced at the top opening, and flows through the cell, eventually exiting through an osmosis filter disposed between the dome and the top edge of the bowl, or alternatively by overflowing at the top opening of the cell. A key advantage of the present invention is that the cell containing the electroplating solution and the substrate material undergoes planetary rotation, that is, a compound rotary motion wherein the cell rotates about its own axis while simultaneously revolving around a fixed axis offset from the axis of the cell. This planetary rotation of the cell eliminates the counter-productive requirement, common in known devices, that electroplating be accomplished with a cycle of periodic stopping and starting, and/or counter rotation with sequential switching of the DC power supply to the cell. Known devices employ these inefficient stop-start and sequential switching methodologies to circulate the particle position for even coverage and prevention of agglomeration/bridging of the substrate material. Thus, in marked contrast with prior devices, the planetary rotation of the cell of the present invention results in the efficient constant movement and controlled agitation of the substrate material in contact with the cathode, with constant rotation of the cell.

The overall and general configuration of a preferred embodiment of the constant rotary flow-through plating apparatus according to the invention is illustrated in FIGS. 1–3 and 15. Principal components of the invention include a rotationally fixed shaft 20, upon which a platen 30 is rotatably disposed, the shaft 20 and platen 30 both being disposed concentrically with and above a rotatable drain basin 24. Bearings 107 may provide for smooth rotatable disposition of the platen upon the shaft 20. The shaft 20 effectively acts as a foundation for many of the other components of the apparatus, and platen 30 rotates about its vertical axis A, which is coaxial with the fixed shaft 20. A constant flow-through bowl assembly 36 is rotatably mounted upon the platen 30 so as to be rotatable about its vertical axis B and with respect to the platen; as shown in the figures, the bowl assembly 36 is mounted eccentrically upon the platen 30, i.e., the bowl's axis of rotation B is offset from the platen's axis of rotation A. Bowl bearings 109 smooth and ease the rotation of the cell bowl assembly 36. A plurality of radially arranged cathode contact strips 44 are uniformly spaced within the bowl assembly in a manner to be described further. An anode assembly 50 is mounted upon a movable boom according to known construction, so that the anode assembly is controllably movable between a use position immersed in solution within the bowl assembly 36 and a retracted position exterior thereof. The upper circumferential rim or edge of the basin 24 is in sealed, but removable, contact with the lower circumferential rim of a closed overarching, e.g. generally hemispherical, canopy 38, so that the combination of the shaft 20, basin 24 and canopy 38 substantially surround and enclose the platen 30 and bowl assembly 36.

In this disclosure, reference is made to an "anode" assembly and to "cathode" contact strips. It is immediately understood by one of skill in the art that the electrochemical roles of the electrodes in an electrolytic cell may be reversed according to the type of electrolysis to be performed. Thus, in every cell there is a primary electrode and an opposing electrode, and which of the pair functions as the anode and which serves as the cathode may be selectively determined by the operator to perform the desired electrolytic process within the cell. Thus, while the electrode 50 movable upon an overhead boom in this disclosure is denoted as an "anode," it may actually serve as an electrode in various alternative embodiments or processes without departing from the scope of the invention. Likewise, the "cathode" contact strips 44 may in alternative applications function as anodic strips. Further, the anode 50 may be either soluble or insoluble according to know principles in the art, depending upon the specific electrolytic process to be performed.

The placement of the anode 50 upon an adjustable boom permits the anode or anode assembly to be controllably disposed into the cell for immersion into the electrolyte, and then controllably withdrawn to a position exterior of the cell. Thus, the anode 50 is positionable outside the bowl assembly 36 so as not to be within the cell during, for example, post- or non-electrolytic processing steps, such as rinsing. Further, a multi-anode assembly may be provided, wherein one type of anode may be withdrawn, and another controllably disposed in its stead, to perform a series of process steps in the cell using different anode types.

A specialized dome 40 is mounted upon and above the bowl assembly 36, with an annular osmosis filter 42 disposed between and in sealed contact with the lower circumferential rim of the dome 40 and the rim of the bowl assembly 36. The bowl assembly 36 and dome 40, together with the anode assembly 50, collectively are the principal elements of the electrolytic cell of the invention. The drain port 26 of the basin 24 is locatable above the inlet of a solution reservoir 80, which may be any one of a plurality of solution reservoirs disposed radially about the exterior of the drain basin 24. Solution from within the reservoir 80 may be pumped into the bowl assembly 36, via one or more feed nozzles 83, by means of a suitable pump 81 and re-circulation conduit 84.

The flow of working solution through the apparatus of the invention during any given treatment cycle is described with reference to FIG. 1. At the outset of operation, with the substrate material previously disposed inside the bowl assembly 36, the re-circulation conduit 84 is connected with the discharge port 85 of a selected solution reservoir 80 containing the first solution or liquid of interest (e.g. a pre-rinse, perhaps de-ionized water). Solution is then pumped by the pump 81, via the discharge port 85, from the reservoir 80 through a filter and then the re-circulation conduit 84 to the feed nozzles 83 and into the bowl assembly 36, until the desired solution level in the bowl assembly is attained. An advantage, therefore, is the recirculation of filtered treatment solution, improving process efficiency without demanding fluid restocking with new, unused solution. The driving mechanisms of the apparatus are actuated to rotate the platen 30 and the bowl assembly 36, and the centrifugal force from the bowl assembly's rotation casts the substrate material against an arcuate segment of the inside wall of the bowl assembly in a manner to be further described. The working solution likewise is urged toward the inside wall of the bowl assembly 36 (where the intended electrolytic processes occur), and tends to flow under centripetal force up to the point of maximum cell diameter, i.e. the annular juncture of the bowl assembly 36 with the dome 40. An annular osmosis filter 42 is situated at the juncture between the rim of the dome 40 and the rim of the bowl assembly 36. The solution then is forced through the osmosis filter 42, and is free to flow by gravity down the exterior bowl skirt 73 and/or the inside surface of the canopy 38 to be collected in the bottom of the drainage basin 24. Recovered solution may then be released through the drain port 26 for return to the solution reservoir 80 for re-use or reclamation, as desired.

Figure 2:
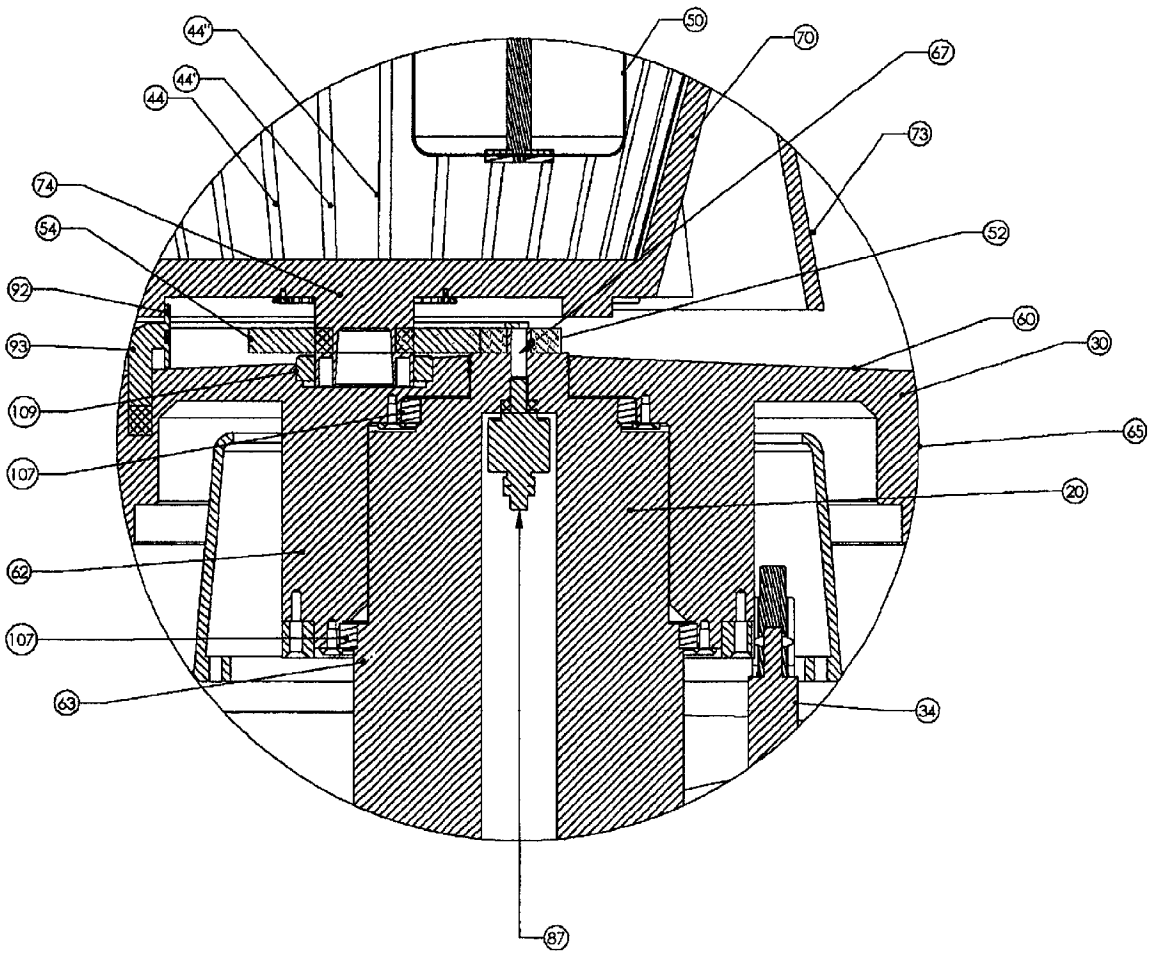
FIG. 2 is an enlarged side sectional view of a portion of the apparatus depicted in FIG. 1.
Figure 12:
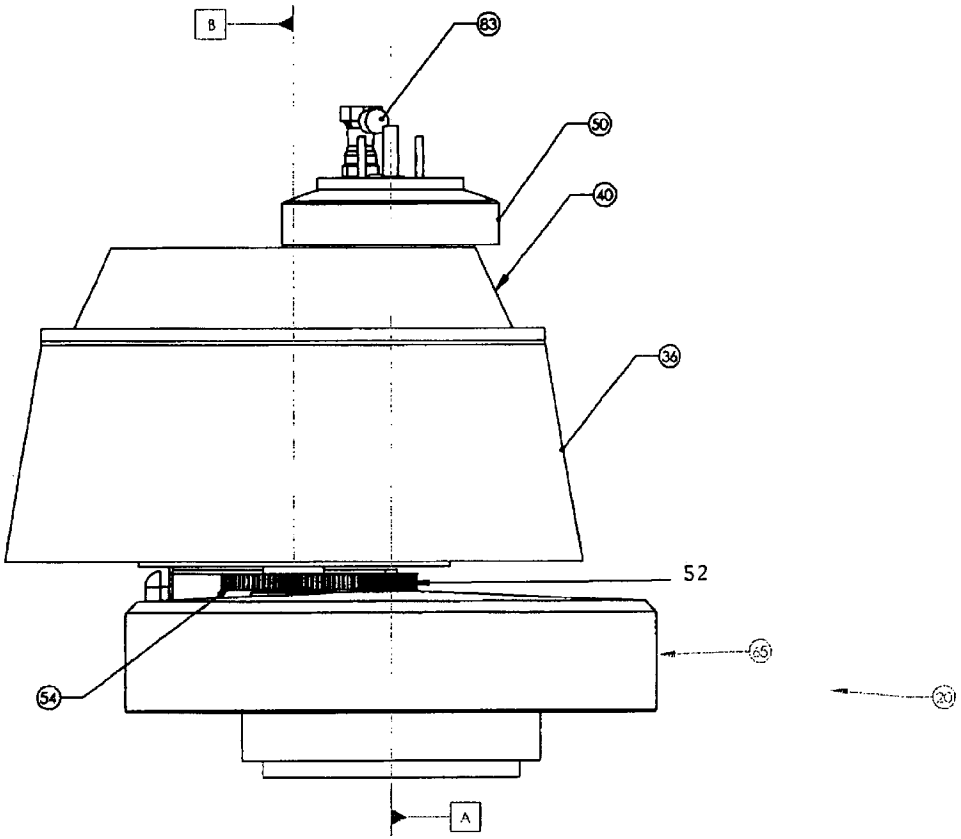
FIG. 12 is a side view of the principal components of the apparatus of the present invention, showing the anode and feed nozzle assemblies in a lowered operational position within the electrolytic cell bowl assembly.

Specific reference is made to FIGS. 1 and 2. The platen 30 is mounted, as with thrust bearings 107 or the like, for rotation upon the upper end of the fixed shaft 20. The hub 62 (or some other suitable portion) of the platen 30 is engageable, as by a pinion gear or the like, with a drive shaft 34 which is operably connected to a drive motor 32. Drive motor 32 turns the drive shaft 34, which when engaged with the platen 30 imparts rotary force to the platen, causing it to rotate about the axis A (FIG. 12) defined by the shaft 20.

Figure 9:
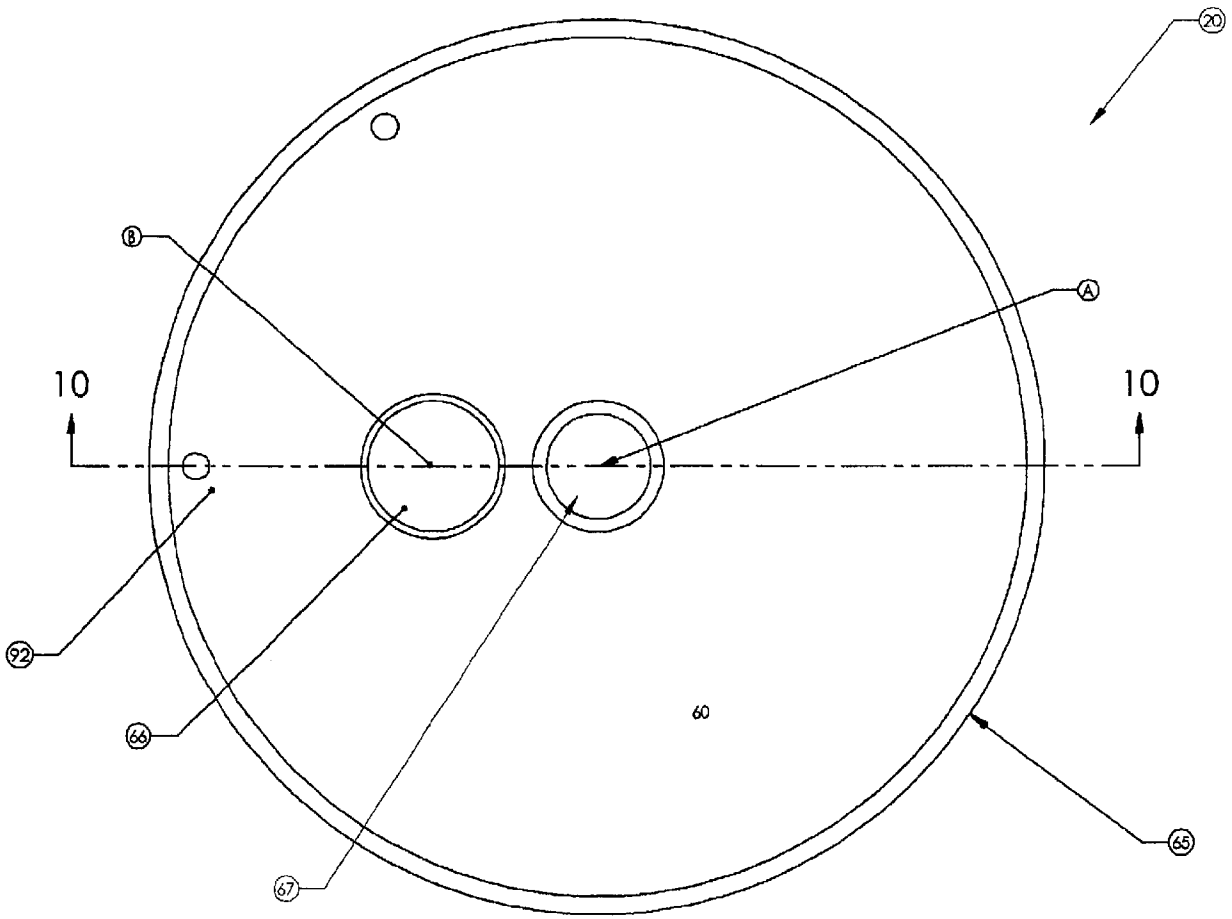
FIG. 9 is a plan view of the platen component of the apparatus of the invention.
Figure 10:
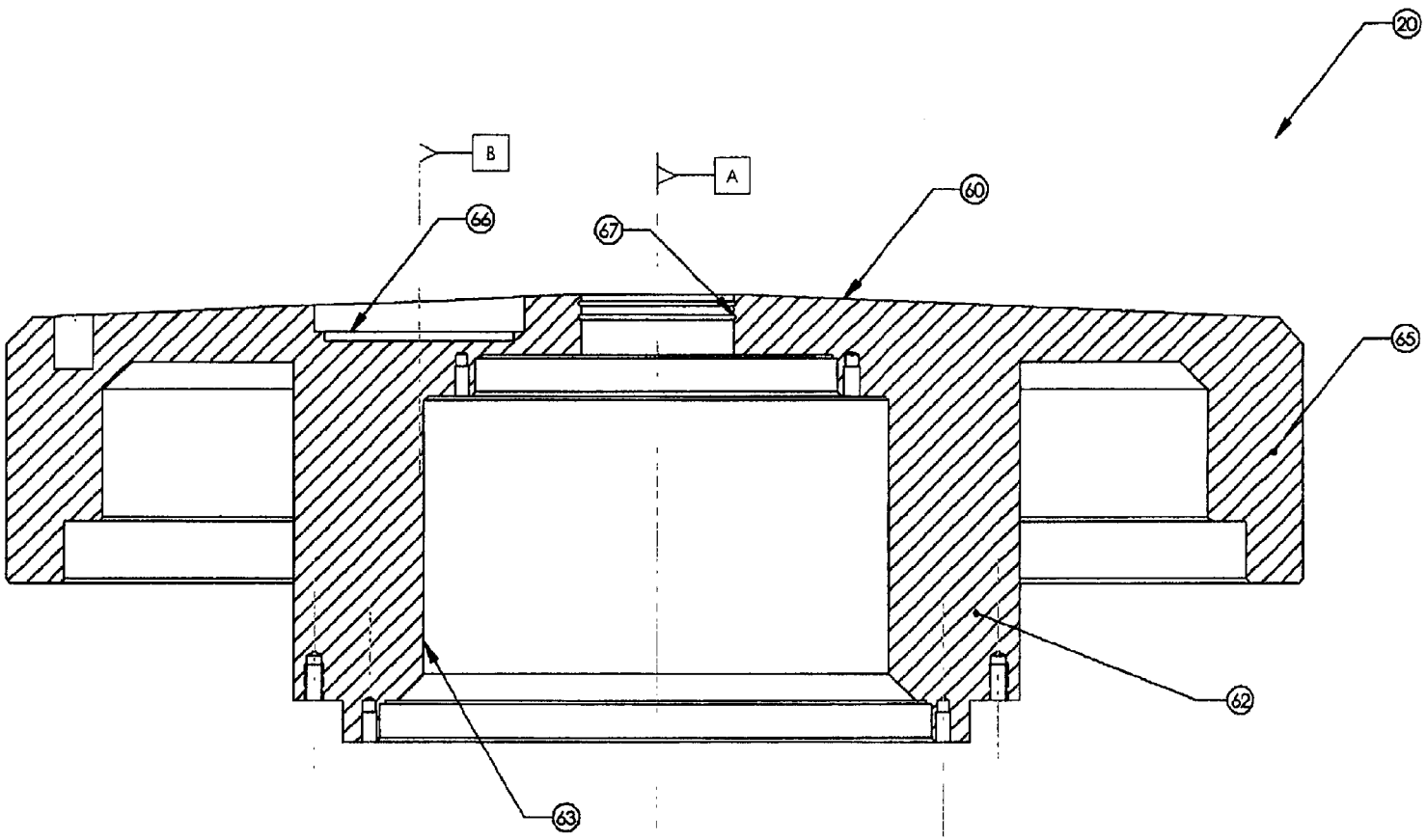
FIG. 10 is a side sectional view of the platen component depicted in FIG. 9, taken along section line 10—10 seen in FIG. 9.
Figure 11:
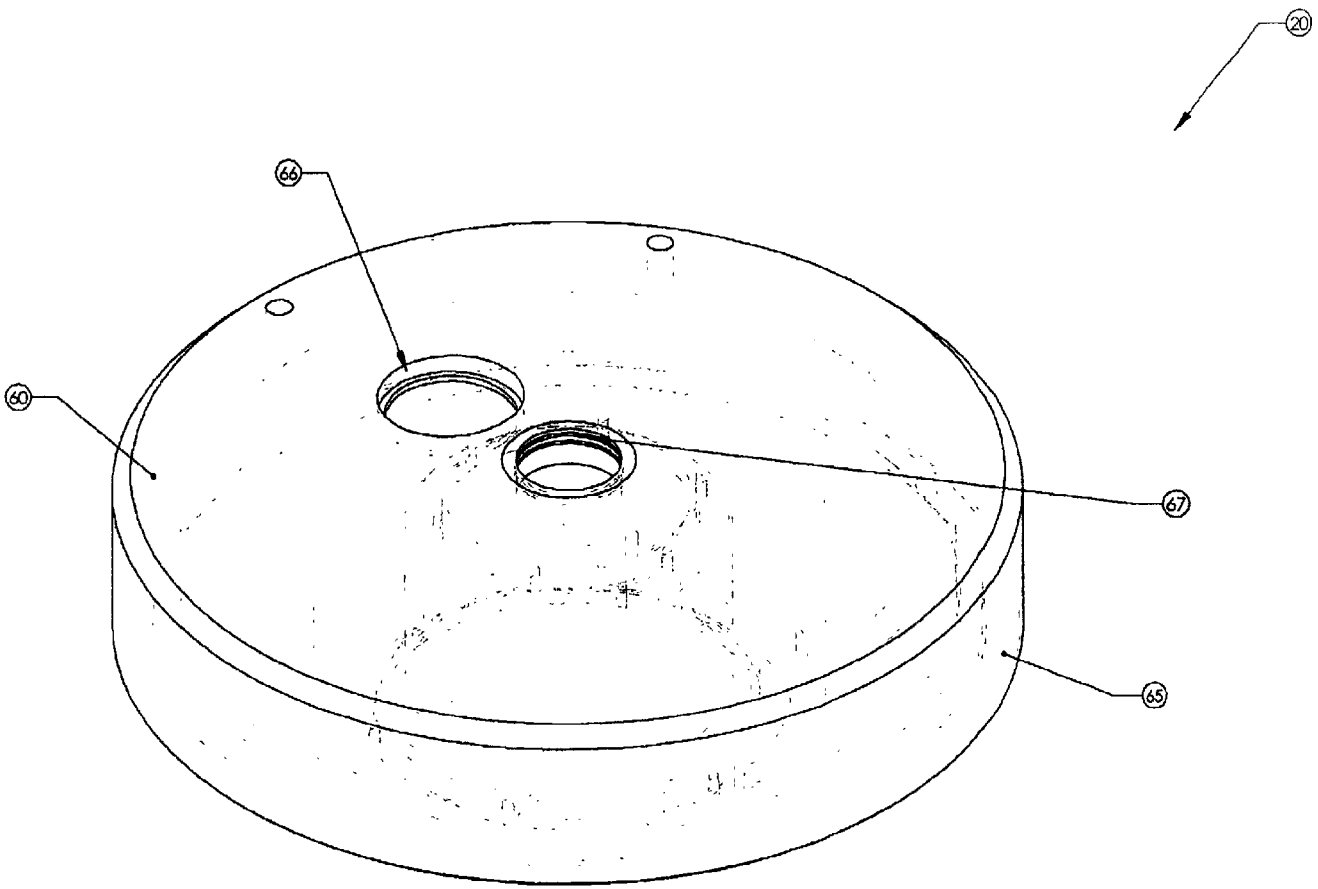
FIG. 11 is a perspective view from above of the platen component of the apparatus of the invention.

Attention is invited to FIGS. 8–11 for additional detail of the platen 30 according to a preferred embodiment of the invention. FIG. 10, in particular, shows how the second axis of rotation B is offset from the first axis of rotation A pertaining to the platen. The body of the platen 30 is fashioned from stainless steel or other suitable durable material, and preferably is circular in plan profile (FIG. 9). The platen 30 features a generally disk-shaped upper portion 60 having an integral, downwardly depending, hollow cylindrical inner hub 62 defining shaft recess 63 therein. A narrowed portion of the shaft recess 63 penetrates the upper portion 60 and is manifested as an access tunnel 67 opening to the top surface of the upper portion. An integral annular outer flange 65 depends downward from the perimeter of the upper portion 60. A circular recess in the top surface of the platen 30 defines a bowl boss seat 66 in the upper portion 60.

Figure 5:
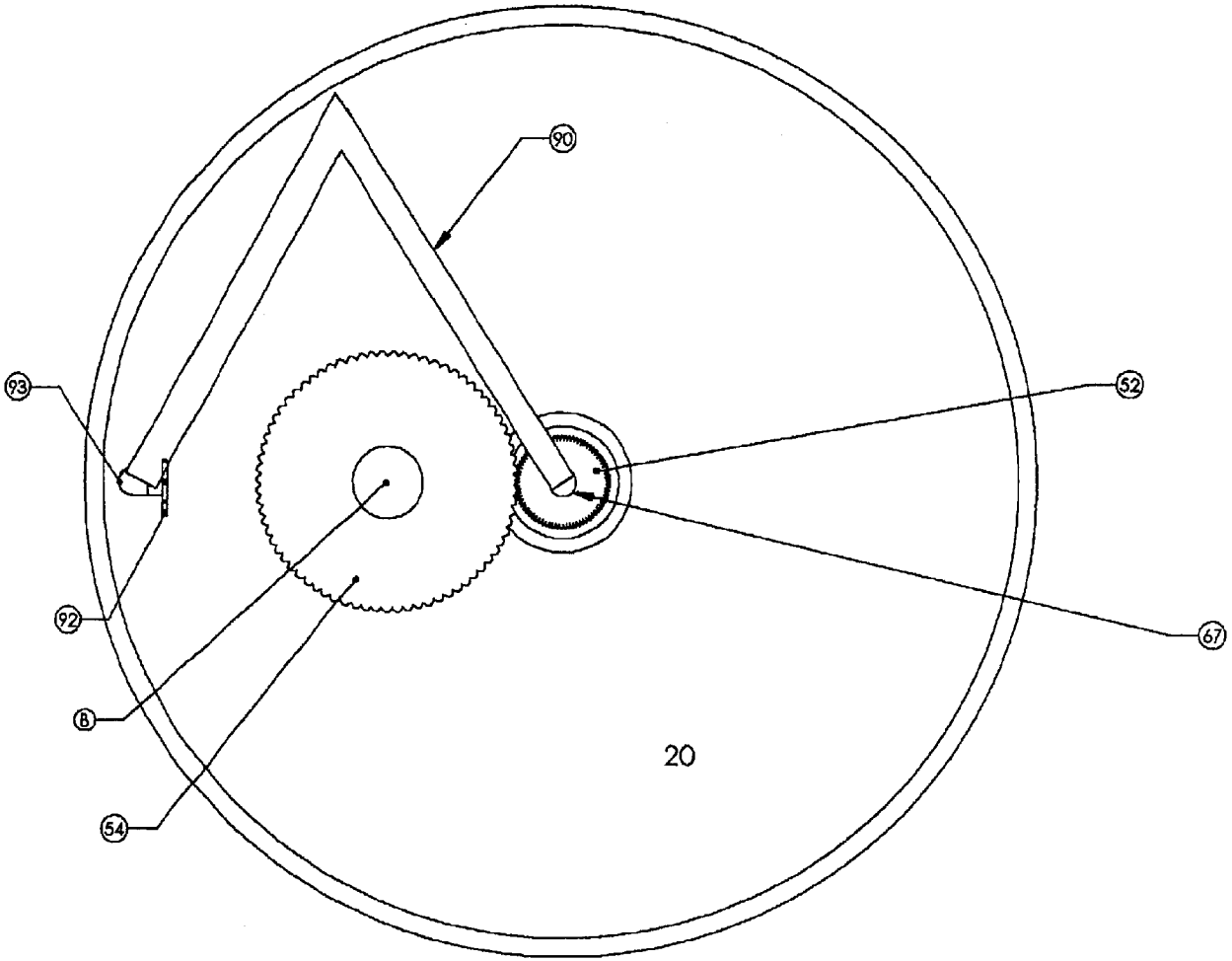
FIG. 5 is a plan view of the platen component of the apparatus of the invention, showing the planetary gear and the electrical cable running from the axis of the drive gear to the wire wheel contact.
Figure 6:
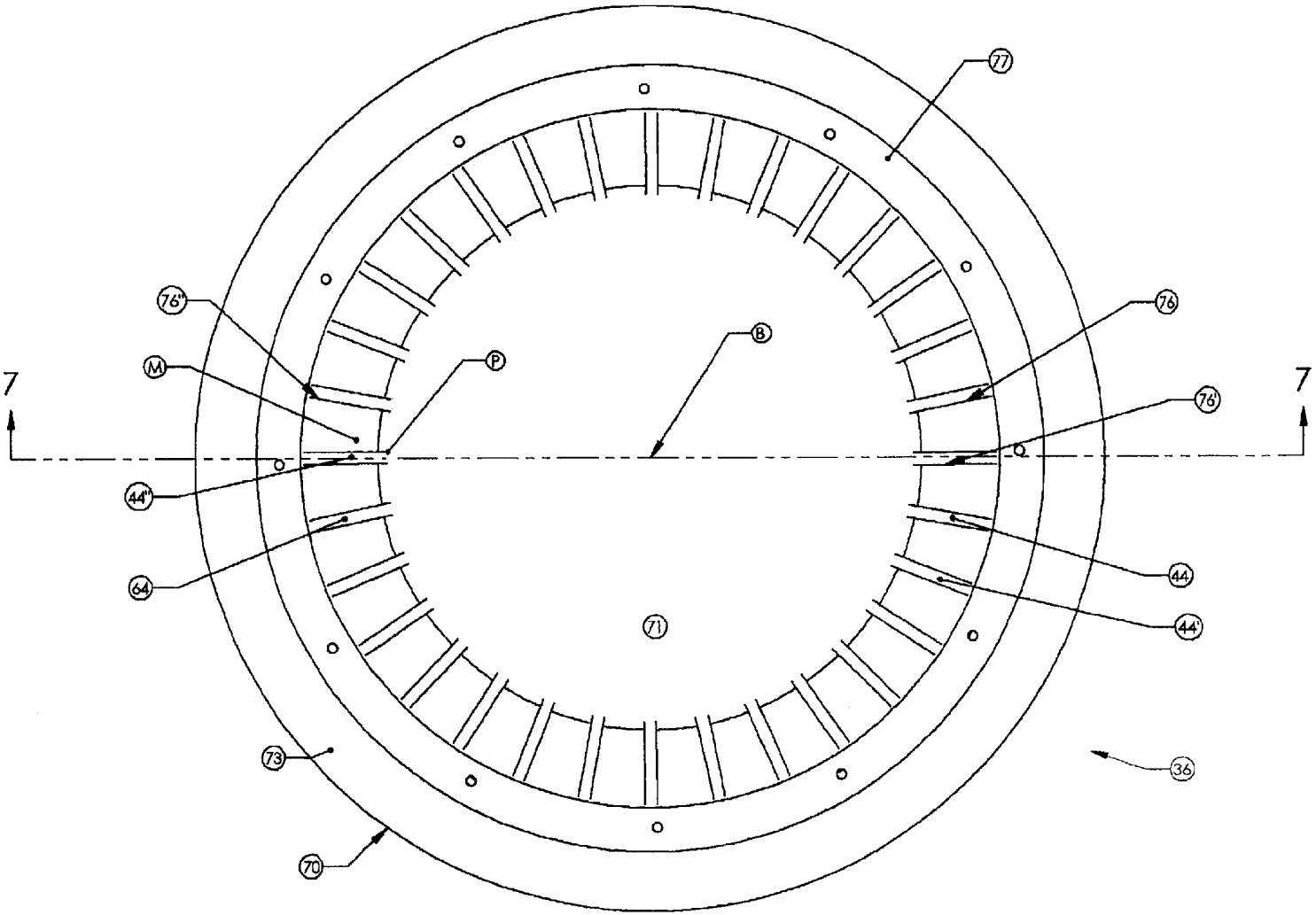
FIG. 6 is a plan view of the interior of the bowl component of the bowl assembly with the dome removed.
Figure 16:
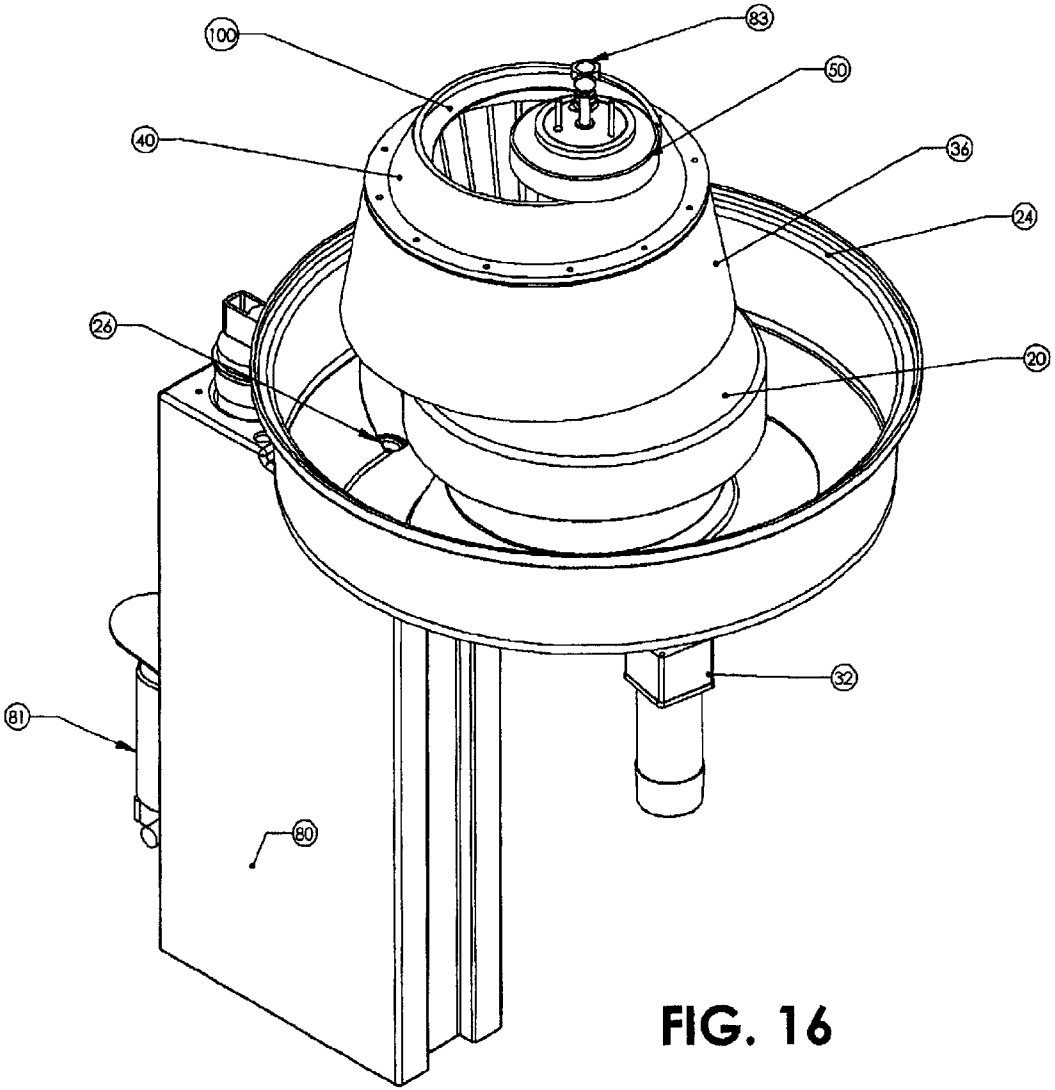
FIG. 16 is a perspective view from above of the overall apparatus according to a preferred embodiment of the invention, but without the containment canopy in place.

The bowl assembly 36 is situated upon the platen 30 for rotation thereupon. Reference is made to FIGS. 5, 6, and 16, which provide further detail of the bowl assembly 36. The bowl assembly 36 includes a rigid, durable bowl 70 in the shape of a truncated cone, having a generally disk-shaped planar floor 71 integrally molded with a frustum-shaped wall 72. Depending downward and radially outward from the wall 72, and preferably integrally molded therewith, is a bowl skirt 73. The entire bowl 70, including the floor 71 and skirt 73, preferably is molded from a suitable inert material, preferably a plastic such as a thermoplastic, or alternatively may be of copolymers, fiberglass or fiber composite. A generally cylindrical centrally located mounting boss 74, preferably integrally molded with the floor 71, depends downward from the bottom surface of the bowl 70. Mounting boss 74 facilitates the rotatable disposition of the bowl 70 upon the platen 20, as the boss 74 is receivable in the bowl boss seat 66 in the upper portion 60 of the platen.

Continued reference is made to FIGS. 5 and 6, illustrating that the bowl 70 defines in the interior surface of the wall 72 thereof a plurality of radially arranged contact channels 76, 76', 76". As best seen in the top view of FIG. 6, the contact channels 76, 76', 76" are disposed in a uniformly spaced, spoke-like array. Contact channels 76, 76', 76" are sized to receive correspondingly-sized cathode contact strips 44, 44', 44". In the preferred embodiment, the cathode contact strips 44, 44', 44" may be integrally molded into the bowl 70 at the time the bowl itself is molded. FIG. 6 shows the cathode contact strips 44, 44', 44" in their radial array; thirty-two uniformly spaced cathode strips are depicted in the plan view of FIG. 6, although for the sake of clarity only three strips 44, 44', 44" are explicitly labeled in the drawing.

Figure 7:
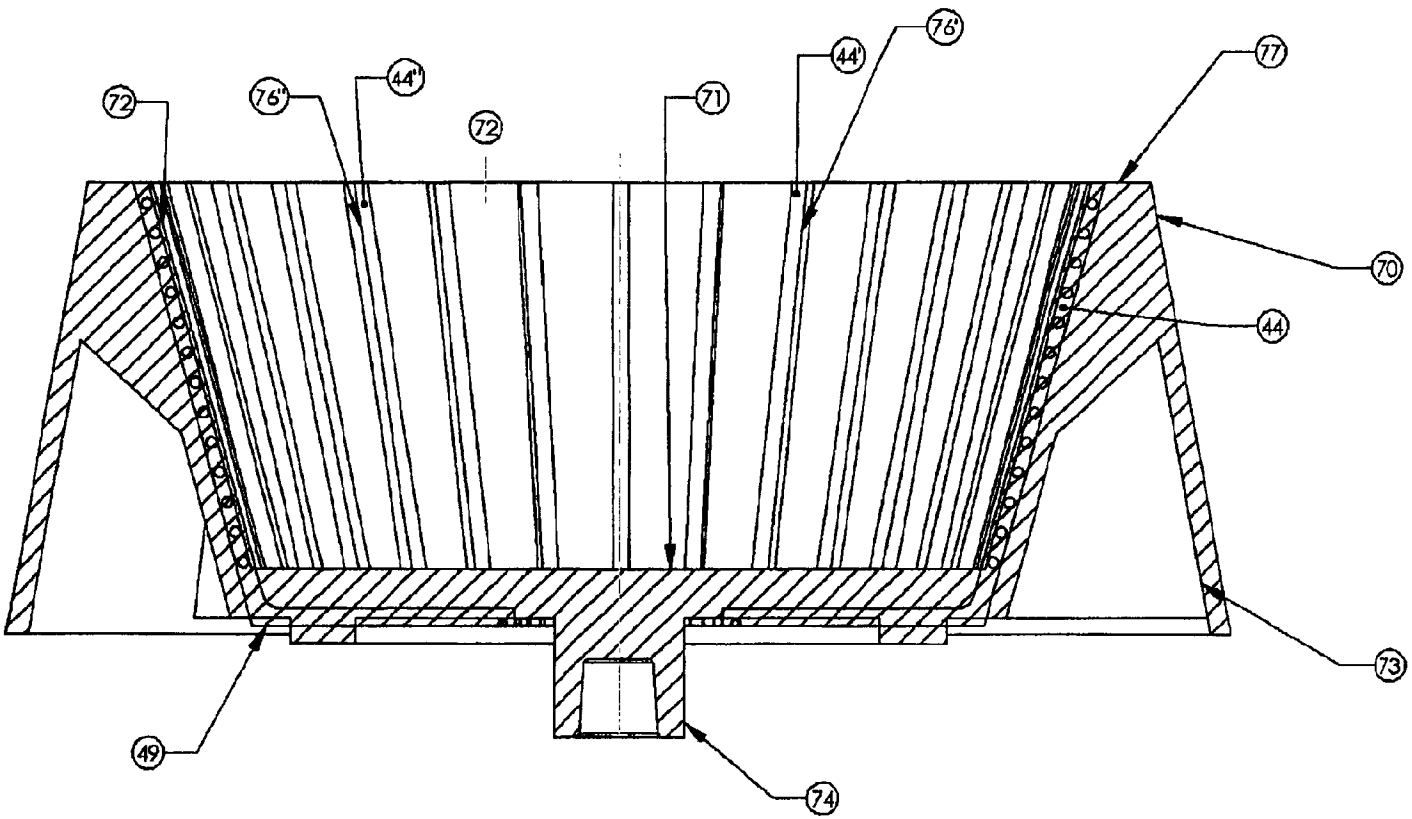
FIG. 7 is a side sectional view of the bowl component depicted in FIG. 6, taken along section line 7—7 seen in FIG. 6.
Figure 8:
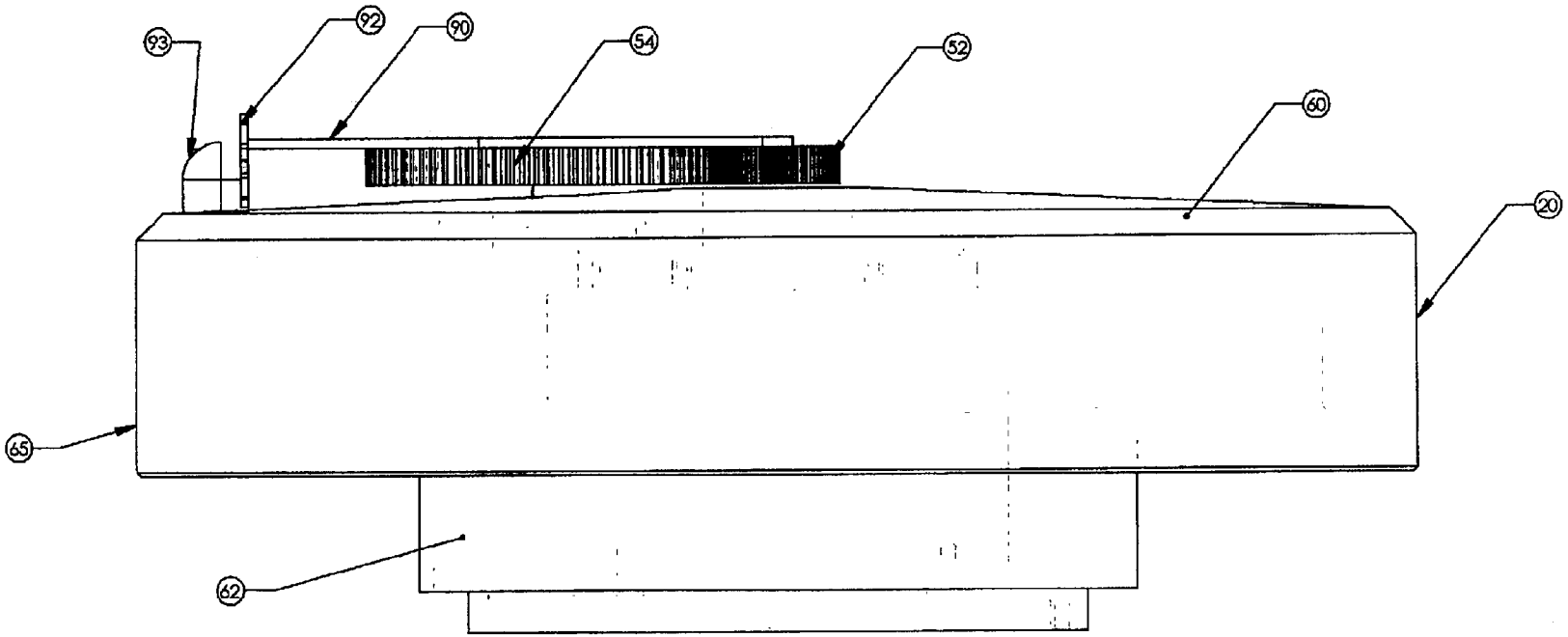
FIG. 8 is a side view of the platen and gear components of the apparatus of the invention.
Figure 17:
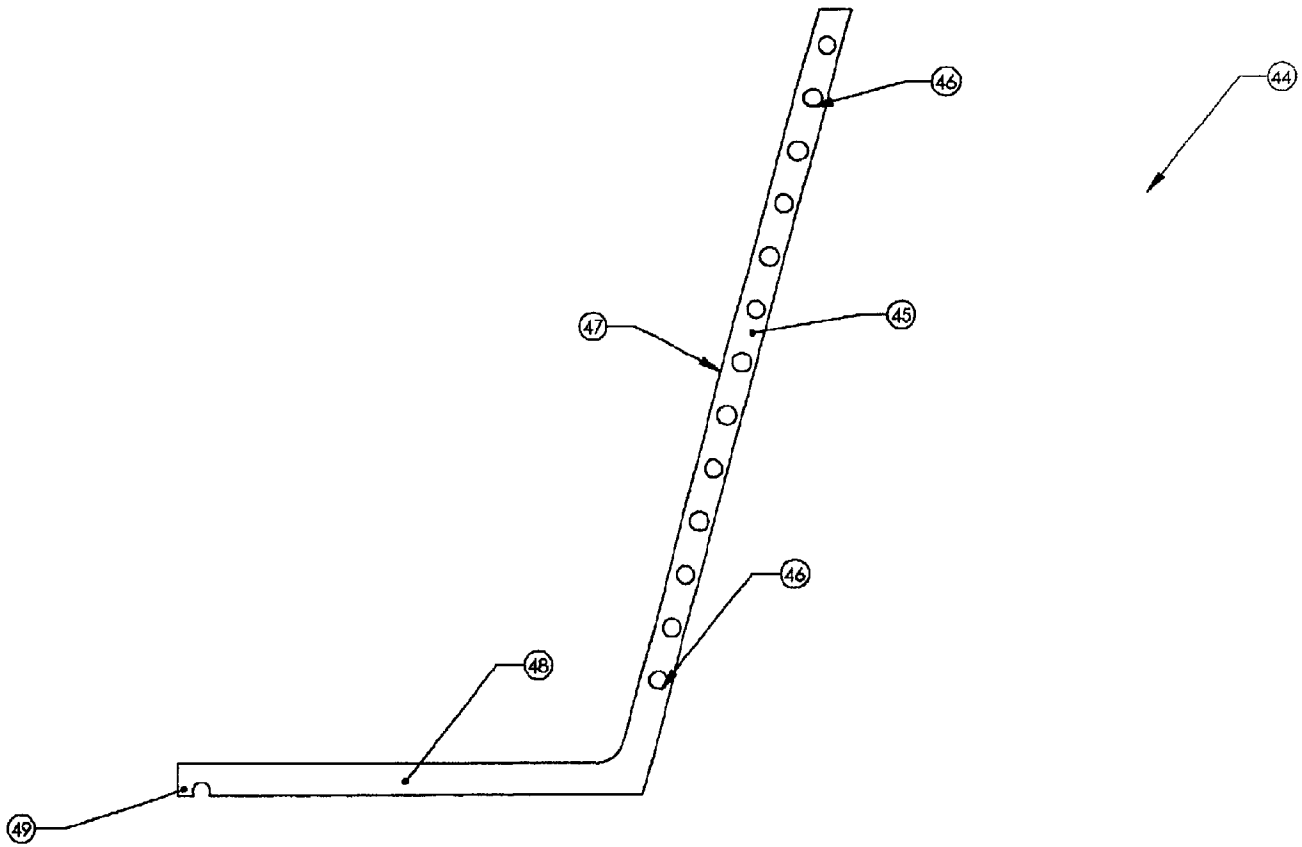
FIG. 17 is a side view of a single cathode contact strip according to the apparatus of the invention, a plurality of such strips being incorporated into the apparatus.

FIG. 17 offers a side view of a single cathode strip 44 fashioned from a durable electrically conductive material, such as titanium. Alternative material possibilities include stainless steel, or copper, depending on the particular process. Description of one strip 44 with reference to FIG.17 serves to describe each in the plurality. The cathode strip 44 has a wall leg 45 and a floor leg 48. The wall leg 45 is inlaid into, or preferably integrally molded into, a corresponding contact channel 76 in the wall 72 of the bowl 70. The wall leg 45 preferably but Optionally may be provided with concave indents or apertures 46, 46' to promote molded bonding with the material of the bowl wall 72 when integrally molded therewith, as suggested by FIG. 7. When the cathode strip 44 is properly disposed in a contact channel 78, the inside face 47 of the wall leg 45 remains exposed to the contents of the bowl 70 (i.e. the electrolytic solution and the substrate material), while the remaining surfaces of the strip 44 are in insulative contact with the material of the bowl. As indicated in FIG. 7, the floor leg 48 of each cathode strip 44 is mostly embedded in the floor 71 of the bowl 70; the floor separates the floor leg from the contents of the bowl. However, as best seen in FIG. 7, a contact portion 49 of the floor leg 48, near its intersection with the wall leg 45, remains exposed on the exterior of the bowl, on the underside of the floor 71 near its perimeter. This contact portion 49 permits an electrical potential to be applied sequentially to individual cathode strips 44, 44', 44" (via a wire wheel contact 92, FIGS. 5 and 8) in a manner to be further described, It is seen therefore, that each cathode strip is everywhere insulated against electrical contact, except at the inside face 47 where electrical contact may be had with the contents of the bowl 70, and at the contact portion 49.

Figure 13:
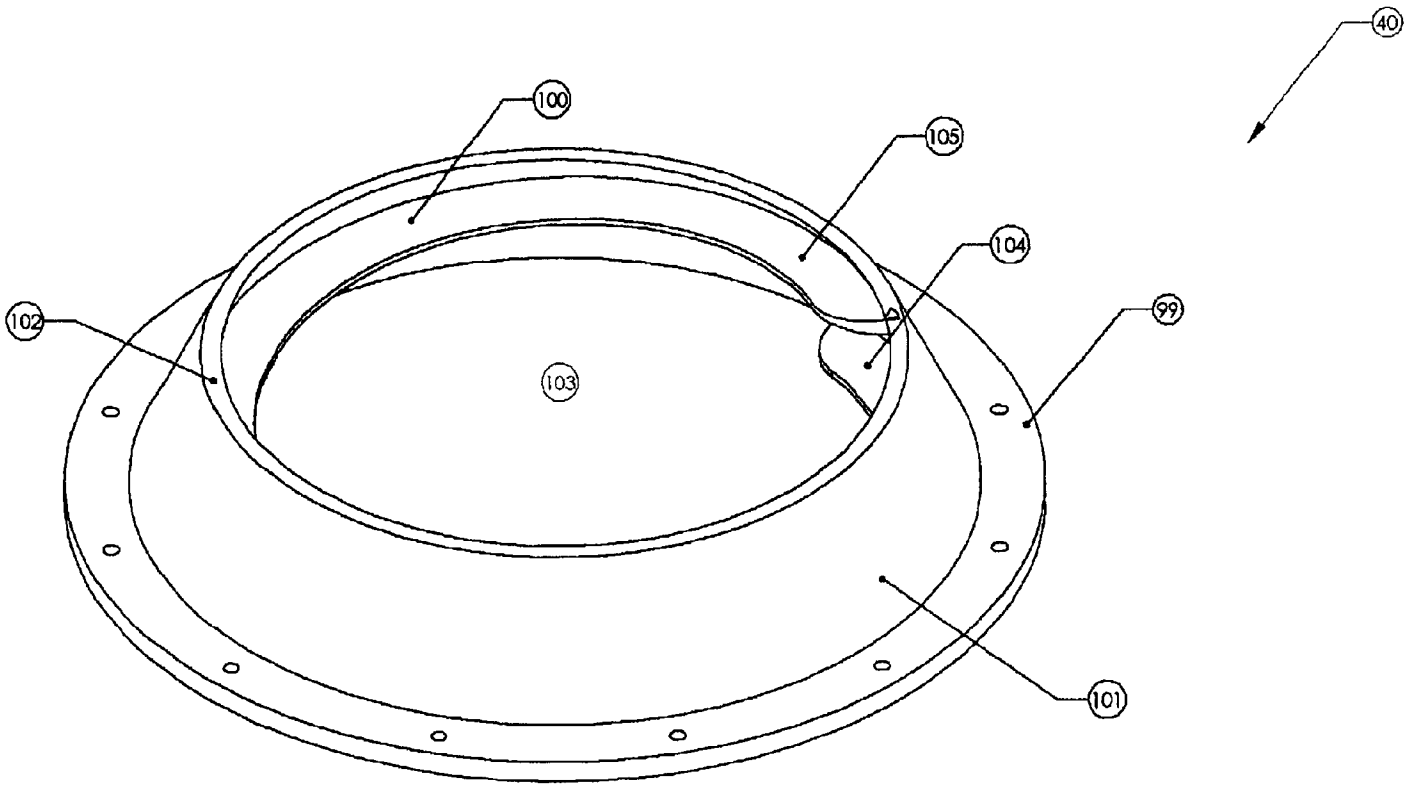
FIG. 13 is a perspective view from above of the dome assembly of the apparatus of the invention, showing the helical auger flange within the dome.
Figure 14:
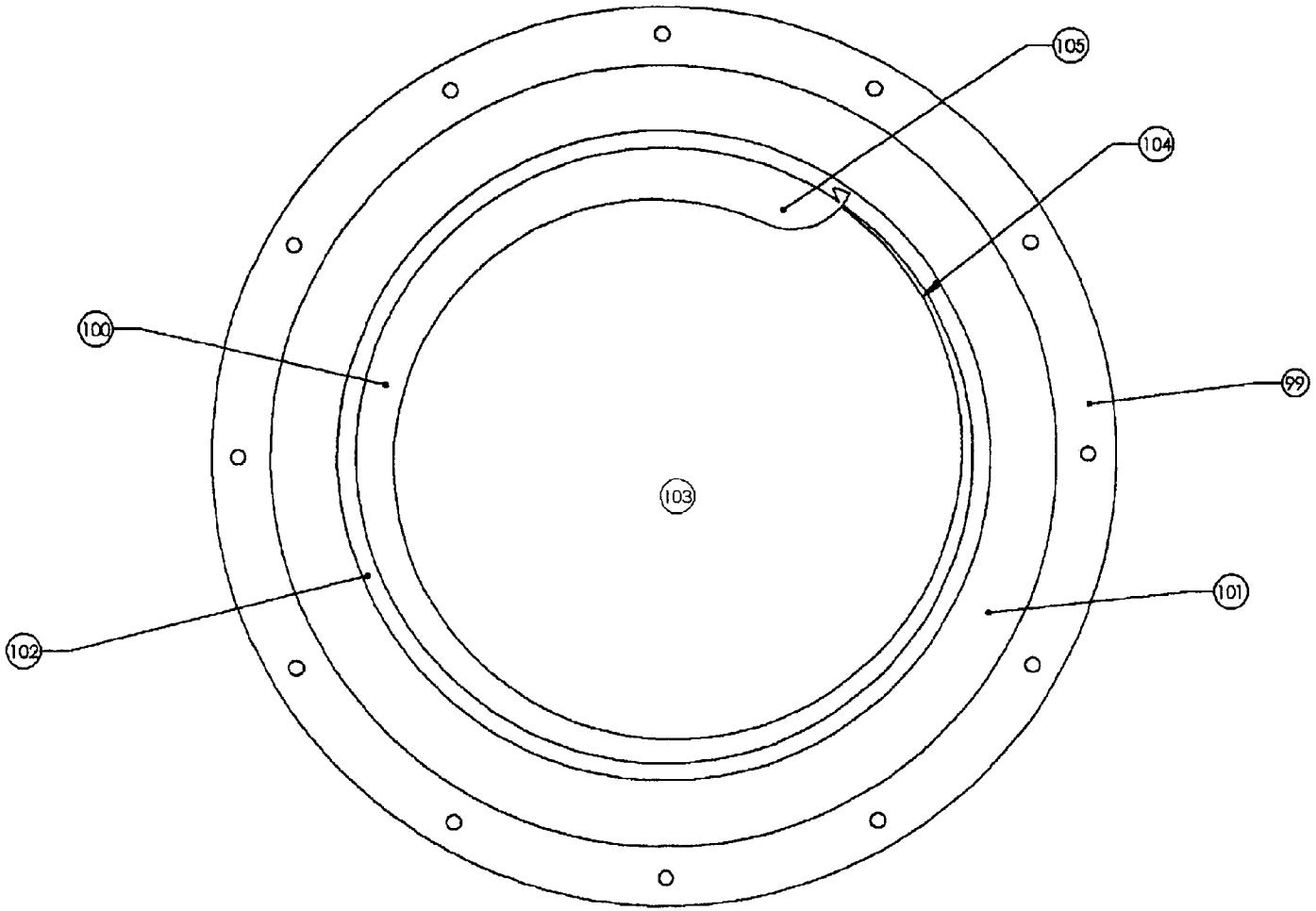
FIG. 14 is a plan view of the dome assembly depicted in FIG. 13.
Figure 15:
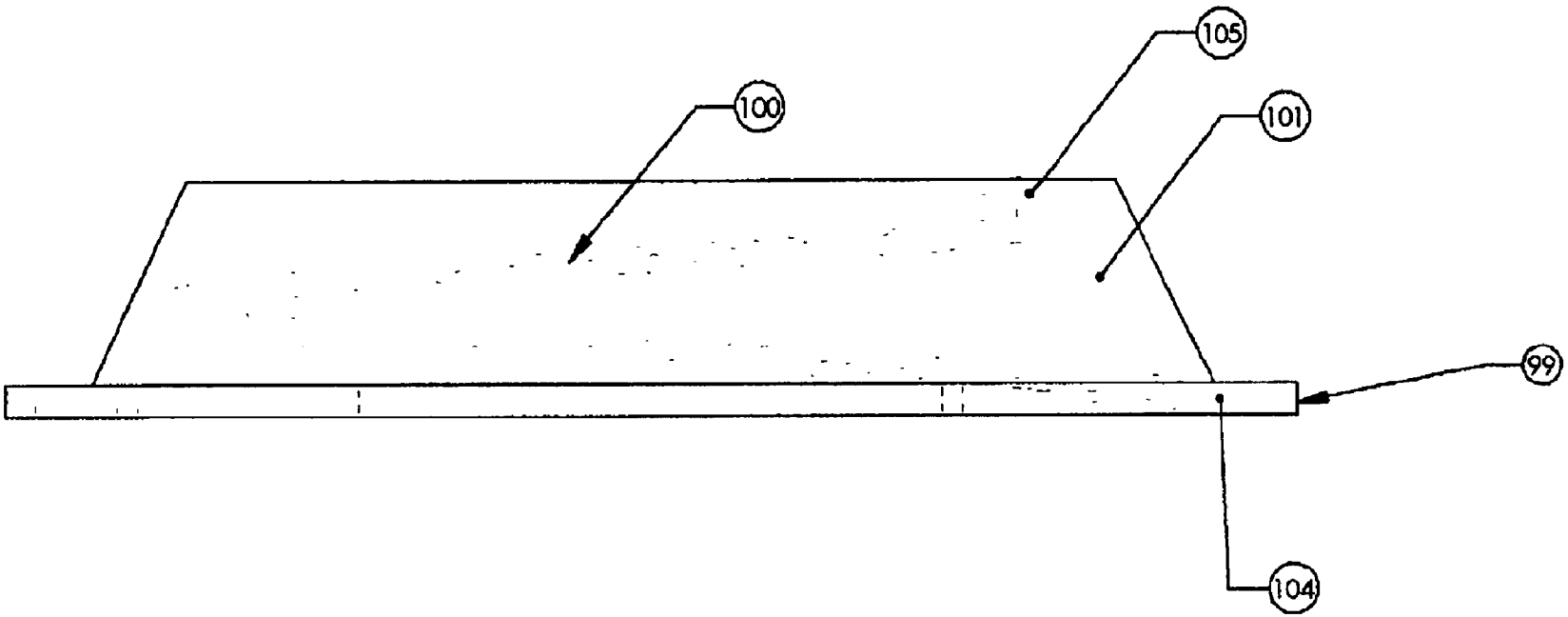
FIG. 15 is a side view of the dome assembly depicted in FIG. 13.

FIGS. 13–15 depict the particular features of the open dome 40 according to a preferred embodiment of the invention. The elements of the dome 40 are crafted from any suitable chemically resistant material or materials, and may be comprised of plastic, fiberglass, or combinations of these or other materials. The dome rim flange 99 is for attaching the dome to the upper rim of the drainage basin 24. Dome 40 has a frustum-shaped wall 101 that converges upwardly to terminate in an annular top rim 102 which defines the broad top opening or port 103. A key feature of the dome 40 is a helical auger flange 100 disposed upon the inside surface of the wall 101. The auger flange 100, from its lower end 104 situated at about the same vertical level as the rim flange 99, spirals upward (progressing clockwise as seen in FIG. 14) to its upper end 105 at about the same level as the top rim 102. The helix of the auger flange 100 preferably spirals through approximately 180 to 190 angular degrees, as suggested in the figures. The auger flange 100 is used especially to extricate from the electrolytic cell the treated substrate at the completion of the treatment process.

Figure 19:
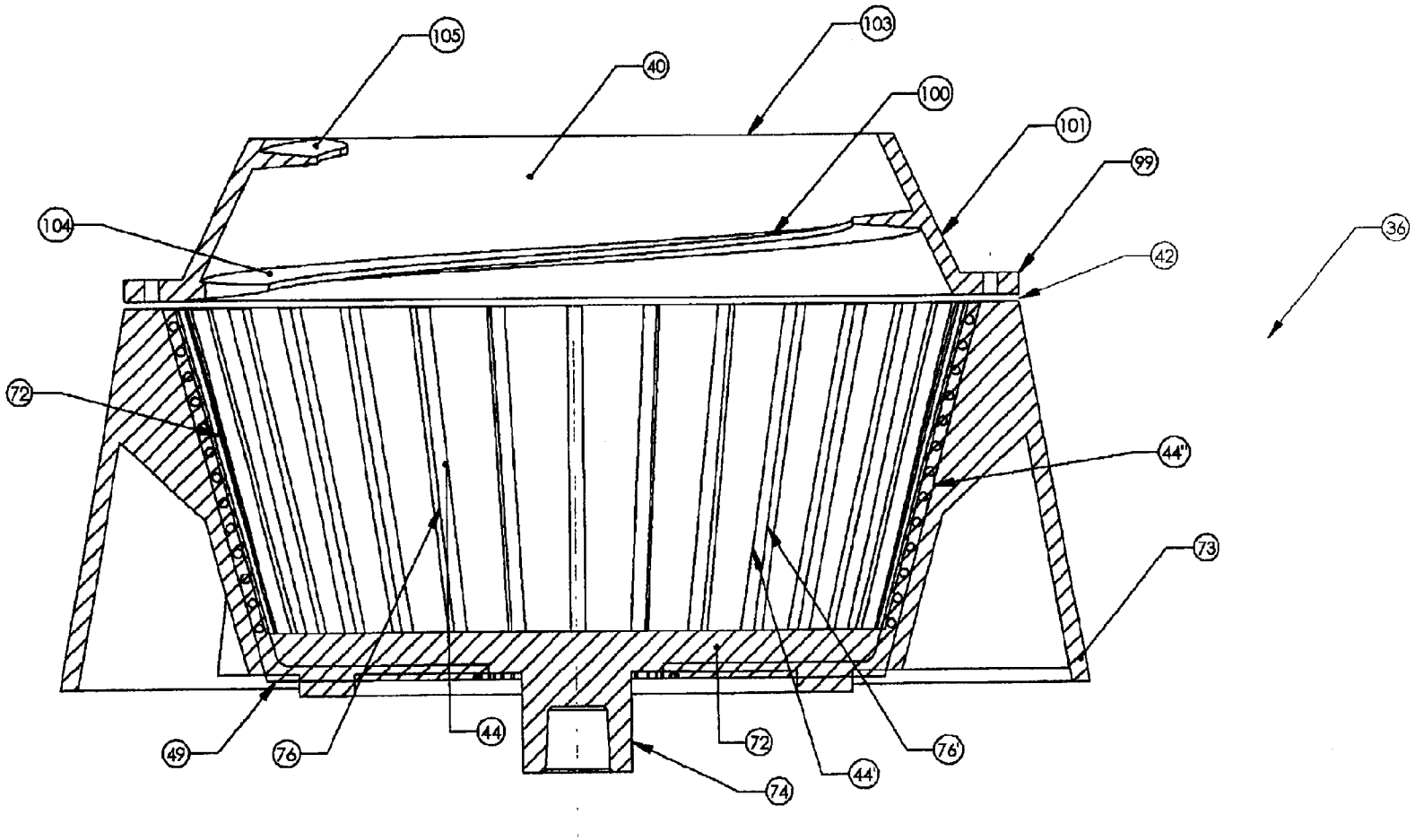
FIG. 19 is a side sectional view of the bowl assembly seen in FIG. 18, taken along section line 19—19 in FIG. 18.

FIG. 19 is a side sectional view of the assembled electrolytic cell of the preferred embodiment of the invention. The bowl 70 includes the radially arranged cathode strips 44, 44', 44" within the bowl wall 72. The dome 40 is removably mounted concentrically upon the bowl 70 by temporarily securing the rim flange 99 of the dome to the upper rim 77 of the bowl wall 72, as by bolts or the like, but with the annular osmosis filter 42 sandwiched there-between. The cell is rotatably coupled to the platen 30 by situating the mounting boss 74 in the bowl boss seat 66 in the upper portion 60 of the platen, as seen in FIGS. 1 and 2. The boss 74 rotates in the seat 66, the contact there-between featuring bearings and/or lubrication to reduce friction. The engagement of the boss 74 in the seat 66 maintains the bowl 70, and thus the complete electrolytic cell, at all times concentric with the circular seat.

Reference is made to FIGS. 1, 2, 4, and 8. Coaxially connected to the top of the shaft 20, and fixed against rotation with respect thereto, is a toothed drive gear 52. Drive gear 52 is fixedly connected to the shaft 20 the access tunnel 67 at the center of the upper portion 60 of the platen 30, but the drive gear is situated at a level somewhat above top surface of the platen, as indicated by the figures. Because the drive gear 52 is fixed against rotation, the platen 30 rotates around the drive gear 52 as well as the shaft 20 when the motor 32 is actuated to drive the platen 30.

Combined reference is made to FIGS. 1 and 2. Attached to the underside of the bowl assembly 36, for example by being secured circumferentially around the mounting boss 74, is a toothed planetary gear 54. The planetary gear 54 is in geared engagement with the drive gear 52, with both the gears arranged about parallel to, and disposed just above, the top surface of the upper portion of the platen 30, as best seen in FIG. 2. Preferably, the planetary gear 54 is removably attachable to the bottom of the bowl assembly 36, so that a variety of different planetary gears may be selectively employed to vary the gear ratio between the drive gear 52 and the planetary gear. Accordingly, if it is desired to rotate the electrolytic cell (around its own axis) at a high rpm, a gear ratio of, for example, 3:1 (planetary to drive) may be selected and a planetary gear of appropriate size selected for temporary but secure attachment to the bowl assembly 36. In many instances, the gear ratio may be 1:1, so that the bowl's rate of rotation is generally equal to its rate of revolution about the first axis A defined by the shaft 20. The bowl 70, being rotatable on the platen 30, likewise is the planetary gear 54 rotatable in relation to the platen.

Continuing reference to FIGS. 1, 4, 8, and 12, and also inviting attention to FIG. 2, it is seen that the afore-described gear train results in a planetary rotation of the electrolytic cell when the platen is rotated upon the shaft 20. When the drive motor 32 is actuated and engaged with the platen (e.g. at the inner hub 62), the platen 30 rotates about its central axis, defined by the shaft 20. As the platen rotates, it carries with it the bowl assembly 36, which is situated upon the platen some distance from the platen's axis of rotation (e.g. the central vertical axis of the bowl assembly is disposed approximately one-third of the radius of the platen from the axis of the platen). Thus, the bowl assembly 36 revolves around the axis of the platen 30. As the bowl assembly 36 revolves, the engagement of the rotatable planetary gear 54 with the fixed drive gear 52 results in the rotation of the planetary gear about its axis. As the planetary gear 54 is compelled to rotate, so too is the bowl assembly 36. Consequently, as the platen 30 rotates about its first, fixed vertical axis, the second vertical axis of the bowl assembly 36 revolves around the platen's axis, the two axes at all times parallel. Concurrently, as the engagement of the fixed drive gear 52 with the rotatable planetary gear 54 compels rotary motion in the planetary gear, the bowl assembly 36 of the electrolytic cell rotates about its axis, since the planetary gear 54 is attached to the bowl's mounting boss 74. The rotation of the bowl assembly 36 thus truly is planetary in relation to the shaft 20.

Reference is made to FIGS. 1, 3, 4, 12, and 16. The apparatus is configured so that, throughout the practice of the invention, the imaginary vertical line defining the first axis A passes through the bowl assembly 36, i.e., a greater or lesser portion of the bowl assembly "overlaps" the fixed axis A. Thus, as the axis B of the bowl assembly orbits the fixed axis A, an ever-changing portion of the bowl 70 always overlies the shaft recess 63. Importantly, during operation of the apparatus the anode assembly 50 is situated near, preferably exactly at, the central vertical axis A of the apparatus. Both the platen 30 and the bowl assembly 36 rotate around the anode 50, but it is seen that as the bowl assembly 36 rotates the distance separating the anode 50 from the bowl wall 72 is constantly changing. Nevertheless, the anode 50 remains within the interior of the single bowl 70 to permit the electrolytic treatment to proceed at the substrate material. With the unmoving anode 50 at the central axis A, the substrate material undergoes treatment at the cathode strips 44, yet the flow-through circulation of the electrolyte is ongoing.

A key advantage of the present invention thus is presented. The electrolytic cell (mainly including the bowl assembly 36) containing the electroplating solution and the substrate material undergoes planetary rotation, that is, a compound rotary motion, wherein the cell rotates about its own axis B while simultaneously revolving around a fixed axis A offset from the axis of the cell. As the cell orbits around the central axis A of the apparatus, the substrate material is cast by centrifugal force against the "outermost" portion of the interior of the bowl 70. As suggested by FIGS. 3 and 6, at any given time during the operation of the invention some point P on the interior face of the wall 72 of the bowl 70 is at a maximum distance from the axis of the rotating platen 30. This outermost point P, being farthest from the platen's axis of rotation, has the highest absolute linear speed. Consequently, the centrifugal force due to rotation of the platen 30 impels the substrate material within the bowl 70 to collect along a short arcuate segment of the wall 72 in the immediate vicinity of the outermost point P. An advantage of the invention therefore is that the substrate material M to be treated tends to collect at a comparatively short segment of the perimeter of the bowl 70, rather than around the entire circumference of the bowl, as in prior art devices.

Figure 3:
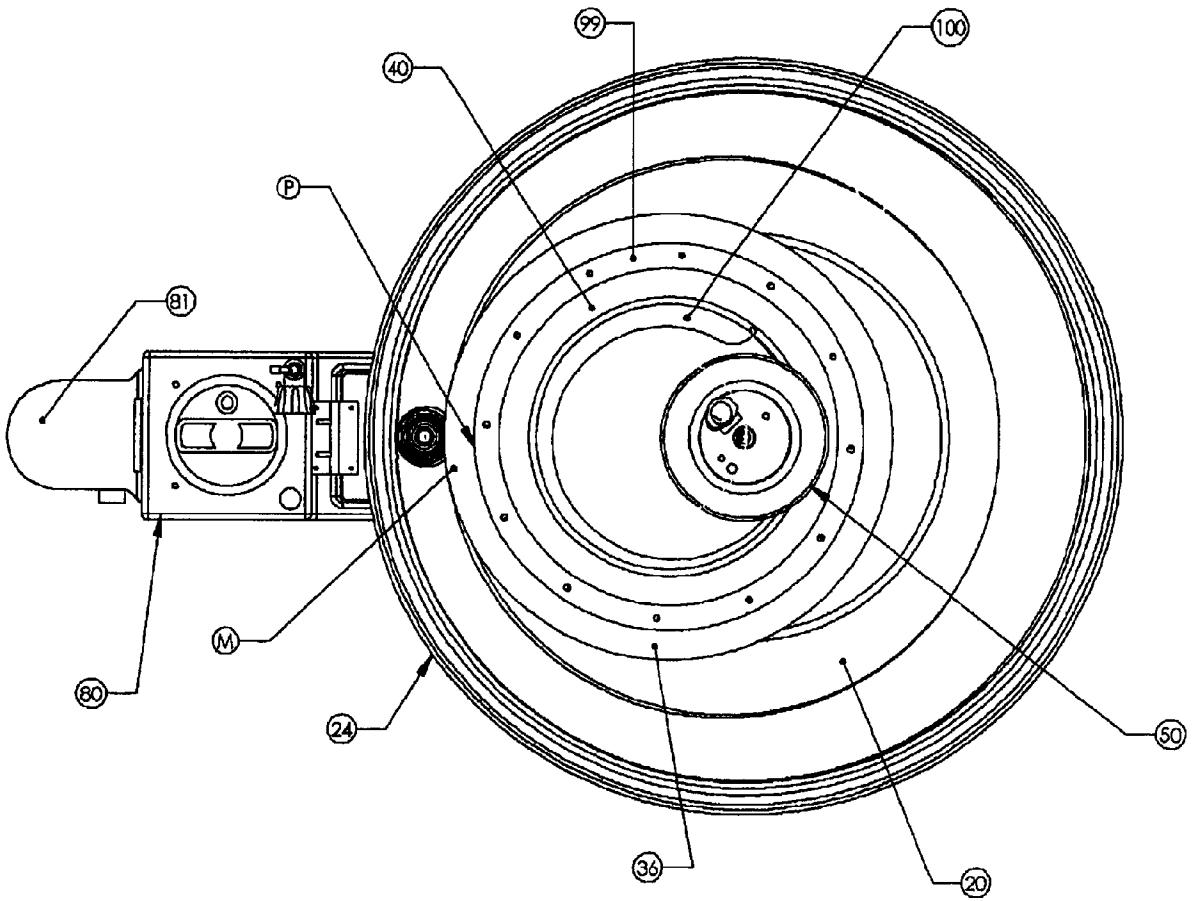
FIG. 3 is a plan view of a preferred embodiment of the apparatus of the invention, with directional arrows showing counterclockwise rotation of the platen and clockwise planetary rotation of the cell bowl assembly.
Figure 4:
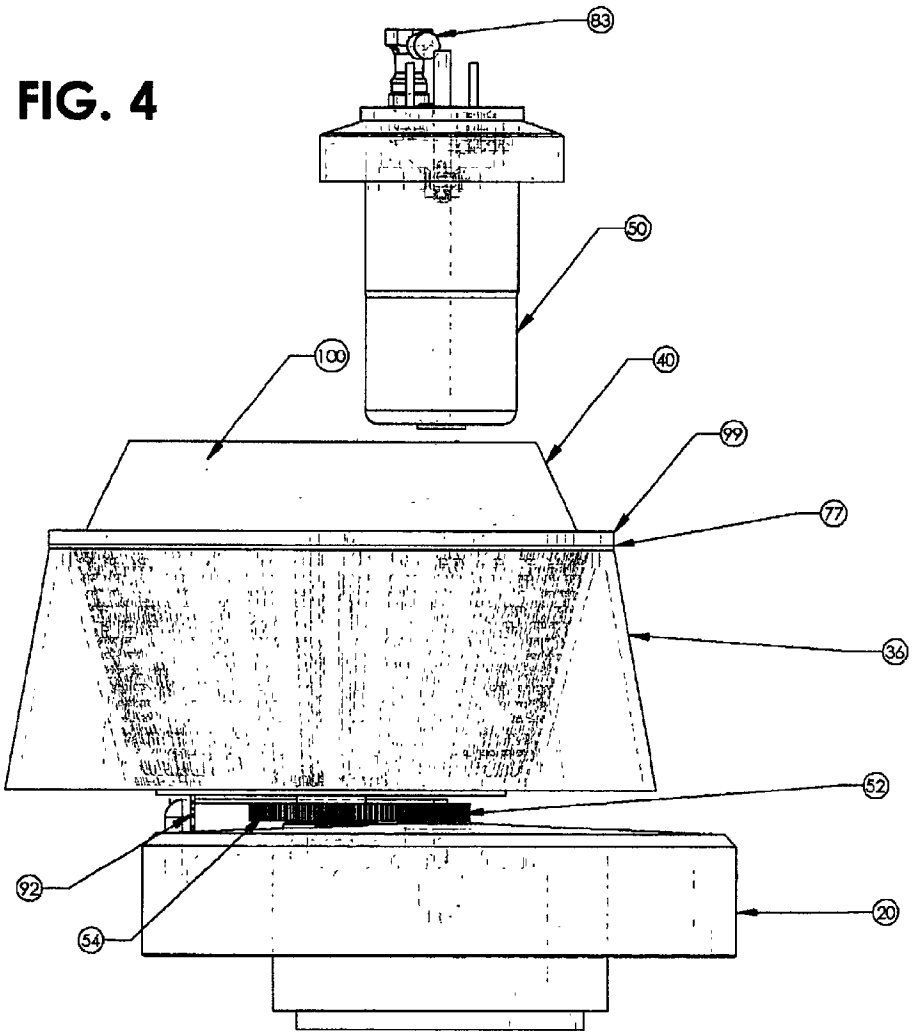
FIG. 4 is a side view of the principal components of the apparatus of the present invention, showing the anode and feed nozzle assemblies in the raised position, withdrawn from the electrolytic cell bowl assembly.

A further advantage of the invention is that while the substrate material M collects at a certain surface within the bowl 70, it nevertheless is in a constant state of agitation. Deliberate agitation of the substrate material fosters uniform electrodeposition upon the individual powder particles. Wherein prior art devices typically repeatedly interrupt and re-start cell rotation to tumble the substrate material, the agitation in the present invention is constant as a result of the continuous rotation of the bowl assembly 36. As seen in FIG. 3 and 6, the rotation of the platen 30 maintains the substrate material against the segment of the bowl adjacent to the outermost point P. However, because the bowl assembly 36 is also constantly rotating about its own axis, the segment of the bowl wall 72 that is at a maximum distance from the platen's rotational axis also is constantly changing. As a result, the substrate material tumbles along the inside wall of the bowl assembly 36, in the vicinity of point P, while the wall of the bowl moves continuously "beneath" it.

Further understanding of this function is had with reference to FIG. 3. It is seen that the platen 30 rotates counterclockwise around first axis A. Because the bowl assembly 36 orbits axis A, the centrifugal force resulting from that revolution forces the substrate material against the wall of the bowl assembly in the vicinity of the outermost point P. However, because the bowl assembly 36 is itself undergoing rotation about axis B, point P is not a point fixed at one physical location on bowl wall 72; rather, P designates a figurative point that is stationary in space (i.e. a point on the perimeter of the bowl at a maximum distance from axis A) in relation to which the wall of the bowl moves. The substrate material tends to collect at point P, but as the bowl wall moves with respect to point P, the substrate material is caused to tumble. The constant tumbling of the material promotes a uniform electrodeposition upon the individual particles of the substrate material.

Because the segment of the bowl assembly 36 against which the substrate material collects is predictable and defined, the apparatus advantageously limits to that segment the application of the working electrical potential. The electrical potential required to perform the electrolytic processing of the substrate material M is applied via the anode assembly 50 and the cathode strips 44, 44', 44".

The mode of applying the working electrical potential to the substrate–a distinct advantage of the invention–is explained with combined reference to FIGS. 2–8, especially FIGS. 5–7. Electricity at the user-selected and appropriate voltage and amperage is supplied from the mercury slip ring 87 to the electrical cable 90 via the access tunnel 67 in the platen 20. Current flows through the cable 90 to the wire wheel contact 92 which is mounted to rotate in a vertical plane upon the axle 93, which in turn is secured to extend from the top of the platen 20. The transmission cable 90 preferably is attached to the upper surface of the platen, as seen in FIG. 5. The cable 90 runs generally radially outward from the access tunnel through the axis of the drive gear 52, and is routed to avoid the planetary gear 54 en route to the wire wheel contact 92. Electrical potential is applied serially to the cathode strips 44, 44', 44" by the wheel contact 92.

As previously mentioned, as the bowl assembly 36 rotates, the substrate material is constantly tumbling or rolling along the inside of wall 72. The general location of the substrate remains unchanged in radial relation to the platen's axis of rotation A due to the centrifugal force of the bowl assembly's revolution around first axis A. The substrate tumbles along the wall 72 due to the rotation of the cell bowl assembly 36 around its own axis B, meaning that the wall 72 has a constantly changing radial relation to the first axis A, and thus is always in motion with respect to the substrate material itself.

Combined reference is made to FIGS. 5 and 6. The bowl's axis of rotation B is depicted in FIGS. 5 and 6; in FIG. 5 the bowl's axis of rotation B appears central to the planetary gear 54 which is coaxial with the cell bowl 70. FIG. 5 also illustrates that the bowl's axis of rotation B is at all times between the wheel contact 92 and the platen's axis of rotation (at the central axis tunnel 67 in FIG. 5). The bowl's axis of rotation B is fixed with respect to the platen 20, the axis' position being at the center of the bowl boss recess 66, as indicated in FIG. 9. The wire wheel contact axle 93 also has a fixed location upon the platen 20. Accordingly, the axle 93, the bowl's axis of rotation B, and the platen's axis of rotation A are always collinear along a radius of the platen, also as best seen in FIG. 9.

Because the wire wheel contact 92 is radially collinear with the bowl's axis of rotation B, the wheel contact 92 is at all times situated below the portion of the bowl 70 that is radially outermost from the platen's axis of rotation A. Thus, even thought the bowl 70 is constantly rotating around its own axis B (and thus the portion of the bowl that is maximally distanced from the first axis of rotation A is constantly changing), the wheel contact 92 ever remains below that outermost bowl portion in the vicinity of point P. Significantly, the mass of substrate to be treated also remains in the vicinity of the outermost point P, so that the wheel contact 92 and the tumbling substrate are always in radial alignment with respect to the bowl's axis B.

The constant radial alignment of the tumbling substrate with the wheel contact 92 allows the application of the working voltage to be coordinated with the position of the substrate. As the bowl assembly 36 rotates about the second axis B, the radially arrayed cathode strips 44, 44', 44" consecutively contact the wire wheel contact 92, which is in rolling contact with the underside of the rotating bowl 70. As the wheel contact 92 turns, the cathode strips 44, 44', 44" come into physical and electrical contact, e.g. one at a time, with the wheel contact 92, permitting a voltage to be applied momentarily to the contacting one of the strips. It will be immediately understood by persons skilled in the art that strips 44, 44', 44" need not make electrical contact with the wheel 92 one at a time; alternatively, the contact strips may be interconnected electrically so as to function in groups (e.g., two to five strips per group). In such alternative embodiments, all the strips in a designated group or cluster are electrically active when any one of them is in electrical contact with the wheel 92. Such alternative embodiments may promote better application of current to some types of treated substrate materials. The temporary and abbreviated electrical connection between each strip 44 or 44" is provided by the rolling contact of the wheel contact 92 with the exposed contact portion 49 on each cathode strip.

At the instant a given one of the cathode strips 44, 44', 44" is in contact with the wheel contact 92, that strip (i.e. strip 44" in FIG. 6) is radially aligned with the outermost point P about which the tumbling substrate is collected. So long as some portion of the collected substrate is in electrical contact with the strip 44" that is also in contact with the substrate, the substrate undergoes electrolytic processing by the electrical current at that strip. As the bowl assembly 36 continues to rotate (e.g. clockwise in FIG. 6), the one cathode strip 44" moves out from beneath the collected substrate and out of contact with the wheel contact 92, and the next adjacent cathode strip (e.g. strip 64 in FIG. 6) moves into contact with (the relatively stationary) substrate and the wheel contact 92, and assumes the role of cathodic electrode. The process is repeated as the bowl assembly rotates, with each of the plurality of cathode strips acting as the working electrode one time per bowl rotation. Advantageously, therefore, electrical potential need be and is applied to only one cathode strip, or interconnected group of cathode strips, at a time, and due to centrifugal collection the substrate material is constantly in contact with the charged electrode strip. The efficiency of the apparatus is marked; among other benefits of the invention is that the only charged cathode strips are the one or more that are in contact with the wheel contact 92 at a given time. All the other strips, having no substrate pressed against them at the time, remain uncharged.

The operation and method of the invention are apparent to one of ordinary skill in the art having reference to the foregoing. The complete apparatus of the invention, in position for use, is depicted in FIG. 16. The substrate material to be treated is deposited in the cell bowl 70, along with the desired volume of electrolytic solution. The drive motor 32 and shaft 34 are actuated, causing the platen to rotate counterclockwise about the fixed first axis (see large directional arrow in FIG. 3), and the engagement of the drive and planetary gears resulting in counterclockwise rotation of the bowl assembly 36 around the second axis (as indicated by the small directional arrow in FIG. 3). The pump 81 is engaged to pump electrolyte into the cell. The cell bowl assembly 36 orbits around the first axis, the resulting centrifugal force causing the substrate to collect along a radially outermost (in relation to the first axis) segment of the inside wall of the bowl assembly. The rotation of the bowl assembly 36 agitates and tumbles the substrate, while the substrate comes into successive brief contact with each one of the cathode strips 44, 44', 44" to permit the electrolytic circuit (including the anode assembly 50) to effectively remain constantly closed. Electrolytic solution is urged by the rotation of the bowl assembly to flow toward the annular osmosis filter 42 (or suitable alternative discharge means) pass therethrough and pour into the basin 24 for collection.

Figure 18:
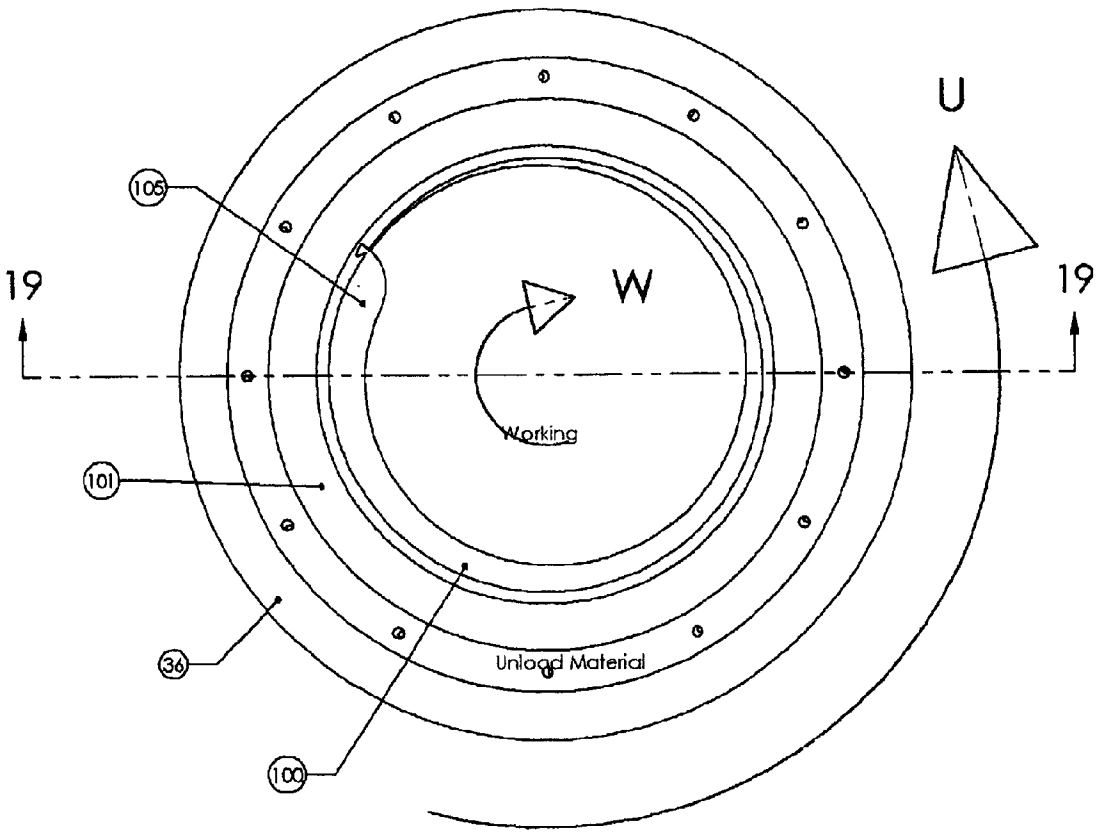
FIG. 18 is a plan view of the cell bowl assembly of the apparatus of the invention, showing with directional arrows that the cell when working rotates clockwise about its axis, and when being unloaded rotates counterclockwise.

During the working stage of the process, the auger flange 100 screws about the second axis B of the cell in a manner that urges the cell contents downward into the cell for continued processing, as suggested by the smaller directional label W in FIG. 18.

Advantageously, processing continues without the need to stop and start the cell to agitate the substrate. Processing may be staged using different chemicals feed nozzles 83 and solution reservoirs 80 according to known methods and devices.

At the conclusion of the complete processing, the discharge of processing or rinsing liquids into the interior of the cell via the nozzle assembly 83 is discontinued, and the vast bulk of the liquid in the cell interior is spun out through the filter 42 by centrifugal force, leaving the substrate comparatively dry. The directions of rotation of the platen 20 and the bowl assembly may then be reversed to empty the substrate from the bowl assembly. The reversal of the direction of bowl rotation, as indicated by the large directional arrow U in FIG. 18, causes the auger flange 100 to auger the substrate out of the bowl 70 for discharge up and out the dome port 103 for collection. Of course, the spiral of the flange 100 can be configured oppositely from that illustrated herein, in which case the direction of rotation of the platen 30 need merely also be reversed to perform the corresponding unloading or downward pushing functions described.

The inventive apparatus has manifold uses. For example, the following materials constitute but a partial list of the powders, micron scale to sub-micron scale, that may be processed in the invention to satisfy particularized needs:

Inert micron scale isotope particles for blood marker.
Critical or fixed stoichiometry alloy composition powders for powder metal forming and solder paste applications.
Filament platinum-coated nickel catalytic submicron powders.
Microsphere grid array microencapsulation of crushed radioactive fuel rods.
Electrosynthesis of ceramic oxides.
Compactible surface alloy for refractory metal powder forming.
Corrosion protection for nanoscale powders.
Insulating and dielectric coatings for soft magnetic powders.
Electrophorectic/electrophrenic polymer coatings on metallic powders.
Noble metal encapsulated base metal powders.
Capacitive dielectric oxide coatings on tantalum powders.
Ordnance powders.
Armor piercing cores.
Metal encapsulated reactive ignition powders.
Metal encapsulated organic materials for implantable pharmaceutical delivery systems.
Metal encapsulated photocopier toner materials.
Anodized aluminum fines for automotive and industrial paint systems.
Metal encapsulated in conductive metal encapsulated particles for arc welding electrode.
Metal coated diamond and refractory metal powders for cutting tool inserts.
Metal-coated graphite particles and fibers.
Composite metal foils.
Multilayer metal alloy powders.
Metallic flake electro-deposited alloys for pigments and printing ink.
Metallic electro-deposited alloys for brazing and soldering powders.
Metal matrix composites.
Powder metal superconductor material.
Inert submicron magnetic particles marker material for nondestructive testing.
The nickel encapsulated metal hydride battery powders.
Insulating metal powders.
Enhanced compaction surface elements.
Electropolished metal powders.
Low fusing temperature metal coatings over metal powders for rapid prototyping using stereo laser systems.
Anodic coatings of submicron metallic powders.
Low noble weight silver termination paste for multilayer chip capacitors.
Low noble weight micron scale nickel/platinum electrode inks for multilayer chip capacitors.
Dielectric coatings on metallic powders for electronic component inks.
Gold-plated stainless-steel powders for medical and dental implantable components.
Compactible permanent magnetic powder.
Frangible bullets.
Thermal management particles for screenable inks.
Solid rocket fuels.
Metallic powder coating pigments.
Colloidal chemical catalysts.
Critical stoichiometry sintered sputtering targets.
Metal encapsulated meso-scale radioactive powder for waste remediation.
Nickel coated iron powder for magnetic recording media.
Multilayer electrodeposited composition powders for pyrotechnics and explosives.
Zinc encapsulated copper powder for batteries.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all patents and publications cited above, are hereby incorporated by reference.

What is claimed is:

1. An electrodeposition apparatus comprising:

a platen rotatable about a first axis;

a rotary flow-through electrolytic cell rotatably mounted upon said platen and rotatable about a second axis, said second axis being offset from and parallel to said first axis; and an electrode assembly disposable into said electrolytic cell;

wherein when said platen is rotated and said electrolytic cell is rotated, said electrolytic cell undergoing planetary revolution with respect to said first axis; and wherein said planetary revolution generates sufficient centrifugal force to overcome suspension of substrate material in a flowing electrolytic solution, the substrate material comprising a particle size of less than 20 micrometers.

2. An apparatus according to claim 1 wherein said electrolytic cell comprises a bowl assembly, said bowl assembly comprising:

a bowl for containing the substrate material and said electrolytic solution;

a plurality of electrodes arranged in a radial array radiating outwardly from said second axis; and means for serially applying electrical potential sequentially to said plurality of electrodes while said electrolytic cell rotates.

3. An apparatus according to claim 2 wherein said plurality of electrodes are electrically isolated in said bowl to have inside faces exposed to the interior of said bowl and contact portions exposed at an undersurface of said bowl, and said means for serially applying electrical potential comprises a wire wheel electrical contact disposed upon said platen in rolling contact with the undersurface of said bowl and intermittently contactable with said contact portions of said plurality of electrodes as said electrolytic cell rotates.

4. An apparatus according to claim 3 wherein said wire wheel electrical contact and said second axis are fixed to be collinear on a common radius of said platen while said platen rotates.

5. An apparatus according to claim 4 wherein the planetary revolution of said electrolytic cell, with respect to said first axis, urges the substrate material to collect by centrifugal force at a portion of said bowl maximally distanced from said first axis, while the rotation of said electrolytic cell about said second axis causes the substrate material to tumble and agitate at said portion of said bowl.

6. An apparatus according to claim 2 wherein said electrolytic cell further comprises a dome assembly disposed upon said bowl, said dome assembly comprising:

a dome wall having a lower rim flange connectable to said bowl and an annular top rim defining a port; and a helical auger flange on the inside of said dome wall and spiraling from about said rim flange to about said top rim;

wherein when said electrolytic cell is rotated in one direction about said second axis, the substrate material is urged downward by said auger flange, and when said electrolytic cell is rotated in a second direction, the substrate material is augered upward toward said port.

7. An apparatus according to claim 1 further comprising means for imparting rotary motion, around said second axis, to said electrolytic cell by rotating said platen.

8. An apparatus according to claim 7 wherein said platen is rotatably mounted upon a fixed supporting shaft, and said means for imparting rotary motion comprises:

a drive gear fixed upon said shaft concentrically with said platen;

a planetary gear fixedly mounted upon a bowl and engaged with said drive gear, and means for imparting rotary motion to said platen;

wherein when said platen is rotated, said bowl orbits around said first axis and said fixed drive gear rotates said planetary gear around said second axis.

9. An electrodeposition apparatus comprising:

a platen rotatable about a first axis;

a rotary flow-through electrolytic cell rotatably mounted upon said platen and rotatable about a second axis, said second axis being offset from and parallel to said first axis;

an electrode assembly disposable into said electrolytic cell; and means for imparting rotary motion, around said second axis, to said electrolytic cell by rotating said platen;

wherein when said platen is rotated and said electrolytic cell is rotated, said electrolytic cell undergoing planetary revolution with respect to said first axis; and wherein said planetary revolution generates sufficient centrifugal force to overcome suspension of substrate material in a flowing electrolytic solution, the substrate material comprising a particle size of less than 20 micrometers.

10. An apparatus according to claim 9 wherein said platen is rotatably mounted upon a fixed supporting shaft, and said means for imparting rotary motion comprises:

a drive gear fixed upon said shaft concentrically with said platen;

a planetary gear fixedly mounted upon said bowl and engaged with said drive gear; and means for imparting rotary motion to said platen;

wherein when said platen is rotated, said bowl orbits around said first axis and said fixed drive gear rotates said planetary gear around said second axis.

11. An apparatus according to claim 9 wherein said electrolytic cell comprises a bowl assembly, said bowl assembly comprising:

a bowl for containing the substrate material and said electrolytic solution;

a plurality of electrodes arranged in a radial array radiating outwardly from said second axis; and means for serially applying electrical potential sequentially to said plurality of electrodes while said electrolytic cell rotates.

12. An apparatus according to claim 11 wherein electrical potential is applied sequentially to individual ones of said plurality of electrodes.

13. An apparatus according to claim 11 wherein electrical potential is applied sequentially to interconnected groups of said plurality of electrodes.

14. An apparatus according to claim 11 wherein said plurality of electrodes are electrically isolated in said bowl to have inside faces exposed to the interior of said bowl and contact portions exposed at an undersurface of said bowl, and said means for serially applying electrical potential comprises a wire wheel electrical contact disposed upon said platen in rolling contact with the undersurface of said bowl and intermittently contactable with said contact portions of said plurality of electrodes as said electrolytic cell rotates.

15. An apparatus according to claim 14 wherein said wire wheel electrical contact and said second axis are fixed to be collinear on a common radius of said platen while said platen rotates.

16. An apparatus according to claim 15 wherein the planetary revolution of said electrolytic cell, with respect to said first axis, urges the substrate material to collect by centrifugal force at the portion of said bowl maximally distanced from said first axis, while the rotation of said electrolytic cell about said second axis causes the substrate material to tumble and agitate at said portion of said bowl.

17. An apparatus according to claim 16 wherein said electrolytic cell further comprises a dome assembly disposed upon said bowl, said dome assembly comprising:

a dome wall having a lower rim flange connectable to said bowl and an annular top rim defining a port; and a helical auger flange on the inside of said dome wall and spiraling from about said rim flange to about said top rim;

wherein when said electrolytic cell is rotated in one direction about said second axis, the substrate material is urged downward by said auger flange, and when said electrolytic cell is rotated in a second direction, the substrate material is augered upward toward said port.

18. An electrodeposition apparatus comprising:

a platen rotatable about a first axis;

a rotary flow-through electrolytic cell rotatably mounted upon said platen and rotatable about a second axis, said second axis being offset from and parallel to said first axis; and an electrode assembly disposable into said electrolytic cell; wherein said electrolytic cell further comprises a dome assembly disposed upon a bowl, said dome assembly comprising:

a dome wall having a lower rim flange connectable to said bowl and an annular top rim defining a port; and a helical auger flange on the inside of said dome wall and spiraling from about said rim flange to about said top rim;

wherein when said platen is rotated and said electrolytic cell is rotated, said electrolytic cell undergoing planetary revolution with respect to said first axis;

wherein said planetary revolution generates sufficient centrifugal force to overcome suspension of substrate material in a flowing electrolytic solution, the substrate material comprising a particle size of less than 20 micrometers.

and further wherein when said electrolytic cell is rotated in one direction about said second axis, substrate material is urged downward by said auger flange, and when said electrolytic cell is rotated in a second direction, the substrate material is augered upward toward said port.

19. An apparatus according to claim 18 wherein said electrolytic cell comprises a bowl assembly, said bowl assembly comprising:

said bowl for containing the substrate material and said electrolytic solution;

a plurality of electrodes arranged in a radial array radiating outwardly from said second axis; and means for serially applying electrical potential sequentially to said plurality of electrodes while said electrolytic cell rotates.

20. An apparatus according to claim 19 wherein said plurality of electrodes are electrically isolated in said bowl to have inside faces exposed to the interior of said bowl and contact portions exposed at an undersurface of said bowl, and said means for serially applying electrical potential comprises a wire wheel electrical contact disposed upon said platen in rolling contact with the undersurface of said bowl and intermittently contactable with said contact portions of said plurality of electrodes as said electrolytic cell rotates.

21. An apparatus according to claim 20 wherein said wire wheel electrical contact and said second axis are fixed to be collinear on a common radius of said platen while said platen rotates.

22. An apparatus according to claim 21 wherein the planetary revolution of said electrolytic cell, with respect to said first axis, urges the substrate material to collect by centrifugal force at a portion of said bowl maximally distanced from said first axis, while the rotation of said electrolytic cell about said second axis causes the substrate material to tumble and agitate at said portion of said bowl.

23. An apparatus according to claim 18 further comprising means for imparting rotary motion, around said second axis, to said electrolytic cell by rotating said platen.

24. An apparatus according to claim 23 wherein said platen is rotatably mounted upon a fixed supporting shaft, and said means for imparting rotary motion comprises:

a drive gear fixed upon said shaft concentrically with said platen;

a planetary gear fixedly mounted upon said bowl and engaged with said drive gear; and means for imparting rotary motion to said platen;

wherein when said platen is rotated, said bowl orbits around said first axis and said fixed drive gear rotates said planetary gear around said second axis.

* * * * *